US008006383B2

(12) United States Patent
Nakashima

(10) Patent No.: US 8,006,383 B2
(45) Date of Patent: Aug. 30, 2011

(54) METHOD OF MANUFACTURING HEAD UNIT

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1010 days.

(21) Appl. No.: 11/850,967

(22) Filed: Sep. 6, 2007

(65) Prior Publication Data

US 2008/0060198 A1 Mar. 13, 2008

(30) Foreign Application Priority Data

Sep. 8, 2006 (JP) ..... 2006-244106

(51) Int. Cl.
*B21D 53/76* (2006.01)

(52) U.S. Cl. ..... 29/890.1; 29/760; 29/DIG. 1; 347/47; 347/65; 347/71; 156/230; 156/580

(58) Field of Classification Search ..... 29/890.1, 29/611, 25.35, 830, 760, DIG. 1; 156/230, 156/323, 580; 347/47, 63, 65, 70, 71
See application file for complete search history.

(56) References Cited

U.S. PATENT DOCUMENTS

| | | | | |
|---|---|---|---|---|
| 5,439,728 | A * | 8/1995 | Morozumi et al. | 347/47 X |
| 2005/0140723 | A1 | 6/2005 | Taira | |
| 2005/0195249 | A1 | 9/2005 | Nakamura et al. | |
| 2005/0278951 | A1 | 12/2005 | Matsuyama et al. | |

FOREIGN PATENT DOCUMENTS

| | | | | |
|---|---|---|---|---|
| JP | 02030449 | A * | 1/1990 | 29/760 X |
| JP | H07-256882 | A | 10/1995 | |
| JP | 2005-138529 | A | 6/2005 | |
| JP | 2005186383 | A | 7/2005 | |
| JP | 2005-246779 | A | 9/2005 | |
| JP | 2006-007442 | A | 1/2006 | |

OTHER PUBLICATIONS

Japanese Office Action issued in corresponding Japanese Application No. 2006-244106, mailed Oct. 7, 2008.

* cited by examiner

*Primary Examiner* — A. Dexter Tugbang
(74) *Attorney, Agent, or Firm* — Baker Botts L.L.P.

(57) ABSTRACT

A frame and an ink-jet head including a nozzle plate and a fixed plate are placed on a first jig having a first face and a second face parallel to the first face and located outside the first face when seen in a direction perpendicular to the first face while being at a predetermined distance from the first face with respect to the direction perpendicular to the first face, in such a manner that a portion of the frame other than a portion formed with an adhesive layer is in contact with the second face, that an ink ejection face of the nozzle plate is opposed to the first face, and that both ends of the fixed plate are in contact with the adhesive layer. Thereafter, the adhesive layer is cured under a state where the ink ejection face is in contact with the first face, so that a head unit is manufactured.

18 Claims, 15 Drawing Sheets

METHOD OF MANUFACTURING HEAD UNIT

CROSS REFERENCE TO RELATED APPLICATION

The present application claims priority from Japanese Patent Application No. 2006-244106, which was filed on Sep. 8, 2006, the disclosure of which is herein incorporated by reference in its entirety.

BACKGROUND OF THE INVENTION

1. Field of the Invention

The present invention relates to a method of manufacturing a head unit having an ink-jet head which ejects ink to a recording medium.

2. Description of Related Art

Japanese Unexamined Patent Publication No. 2005-186383 discloses an ink-jet head assembly including a plurality of ink-jet heads each having an elongated plate with both ends thereof not being in contact with other plates, and a frame to which each of the ink-jet heads is fixed via the elongated plate. Each of the ink-jet heads includes a head main body, a reservoir unit, and the elongated plate. The head main body has a passage unit and an actuator unit. The reservoir unit is fixed to an upper face of the passage unit. The elongated plate is fixed to an upper face of the reservoir unit. The passage unit is formed therein with a plurality of individual ink passages each extending from a manifold channel through a pressure chamber to a nozzle. The actuator unit applies pressure to ink in the pressure chamber.

In the ink-jet head assembly, a plurality of through holes are formed in the elongated plate of the ink-jet head. The through holes are formed through a thickness of the plate, and arranged along a lengthwise direction of the plate. On the upper face of the reservoir unit, threaded holes are formed at positions corresponding to the through holes. Bolts which are inserted through the respective through holes are screwed into the threaded holes, so that the elongated plate and the reservoir unit are fixed to each other while a flat lower face of the elongated plate is being in tight contact with the upper face of the reservoir unit. As a result, upper and lower faces of the reservoir unit are prevented from being bent in a direction perpendicular to a plane direction, and therefore upper and lower faces of the passage unit are corrected into parallel with the lower face of the elongated plate. This improves flatness of the lower face of the passage unit, that is, flatness of an ink ejection face in which a plurality of nozzles open.

SUMMARY OF THE INVENTION

According to the above-mentioned publication document, the reservoir unit is formed by five plates being bonded to each other with an adhesive. The passage unit is formed by nine plates being put in layers so as to form a plurality of individual ink passages. A plurality of holes corresponding to manifold channels, pressure chambers, nozzles, and the like are formed in the respective nine plates. If the nine plates are bonded to each other with an adhesive, there may be a variation among a thickness of the adhesive among the nine plates, a thickness of the adhesive between the passage unit and the reservoir unit, and a thickness of the adhesive among five plates of the reservoir unit. As a result, a distance between the elongated plate and the ink ejection face with respect to a direction perpendicular to the ink ejection face varies among the ink-jet heads. In an ink-jet head assembly having such ink-jet heads fixed to a frame, a distance between the frame and the ink ejection face varies among the ink-jet heads. If a printing is performed with a printer provided with such an ink-jet head assembly, a print quality decreases because an accuracy of a landing position of ink ejected from a nozzle varies among the ink-jet heads.

An object of the present invention is to provide a method of manufacturing a head unit which presents a constant distance between an ink ejection face and a frame having an ink-jet head fixed thereto.

According to an aspect of the present invention, there is provided a method of manufacturing a head unit, comprising an ink-jet head forming step, an adhesive layer forming step, a placing step, and an adhesive layer curing step. In the ink-jet head forming step, an ink-jet head having an ink passage extending from an ink supply port to a nozzle which ejects ink is formed by putting in layers a plurality of plates which includes a nozzle plate having an ink ejection face on which the nozzle is opened and a fixed plate to be fixed to a frame. The fixed plate has both ends thereof not being in contact with the other plates. In the adhesive layer forming step, an adhesive layer is formed on the frame. In the placing step, the frame and the ink-jet head are placed on a first jig having a first face and a second face which is parallel to the first face and located outside the first face when seen in a direction perpendicular to the first face while being at a predetermined distance from the first face with respect to the direction perpendicular to the first face, in such a manner that a portion of the frame other than a portion formed with the adhesive layer is in contact with the second face, that the ink ejection face is opposed to the first face, and that the both ends of the fixed plate are in contact with the adhesive layer. In the adhesive layer curing step, the adhesive layer is cured after the placing step, under a state where the ink ejection face is in contact with the first face.

In the aspect, in the adhesive layer curing step, the adhesive layer is cured under the state where the both ends of the fixed plate are in contact with the adhesive layer and the ink ejection face is in contact with the first face. Accordingly, a distance between the frame and the ink ejection face is constant because it is regulated as the predetermined distance between the first face and the second face of the first jig. Therefore, when a plurality of head units are manufactured using the first jig, a distance between the frame and the ink ejection face is the same in all the head units. As a result, in a recording apparatus such as a printer mounted with the respective head units by the frame, a level of the ink ejection face does not vary among the head units and therefore stable print quality can be obtained.

BRIEF DESCRIPTION OF THE DRAWINGS

Other and further objects, features and advantages of the invention will appear more fully from the following description taken in connection with the accompanying drawings in which:

FIGS. 9A, 93, and 9C timewisely show the process of forming the ink-jet head according to the first embodiment of the present invention;

DESCRIPTION OF THE PREFERRED EMBODIMENTS

In the following, some preferred embodiments of the present invention will be described with reference to the accompanying drawings.

Figure 1:
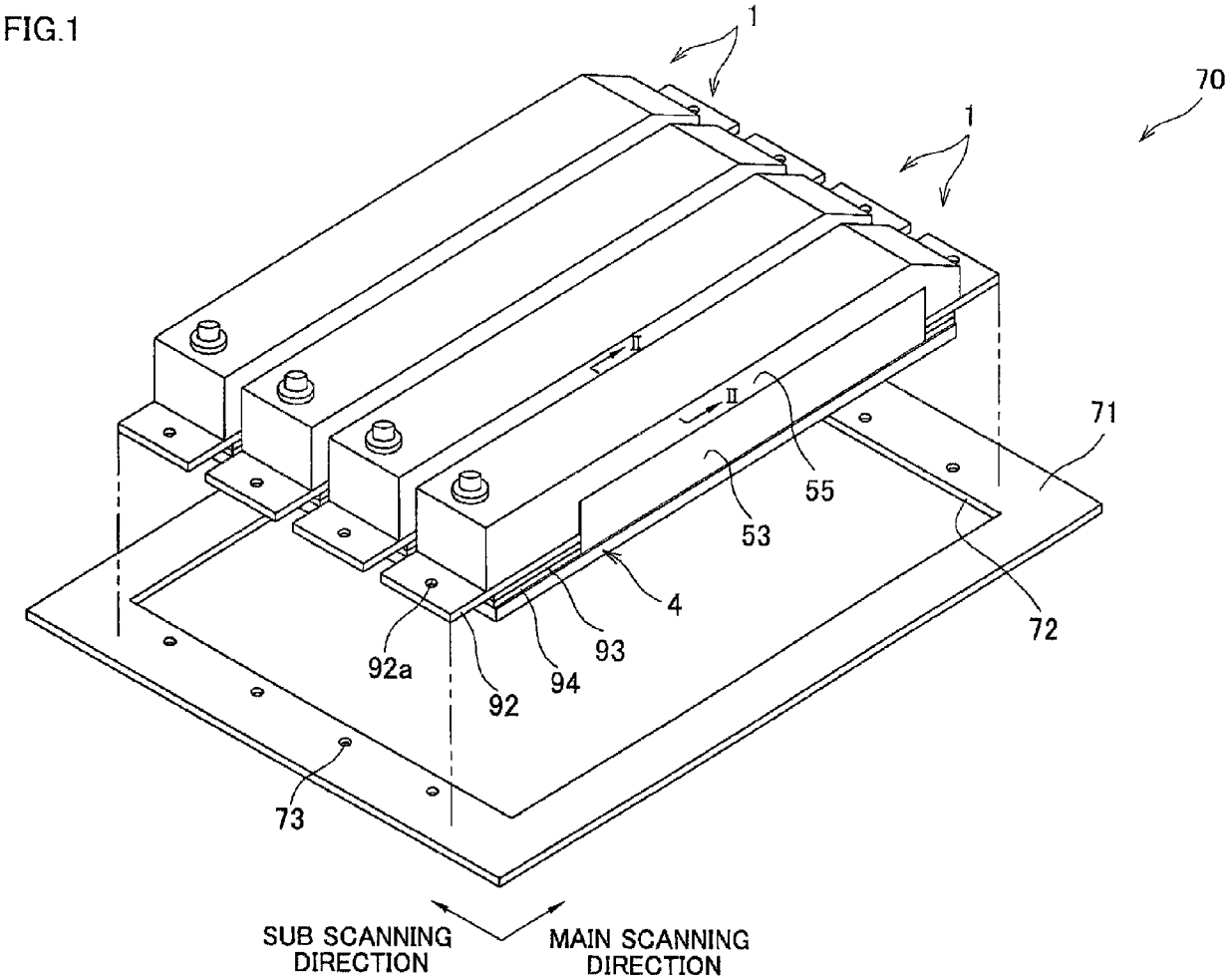
FIG. 1 is an exploded perspective view of a head unit which has been manufactured by a manufacturing method according to a first embodiment of the present invention.

FIG. 1 is an exploded perspective view of a head unit which has been manufactured by a manufacturing method according to a first embodiment of the present invention.

Figure 2:
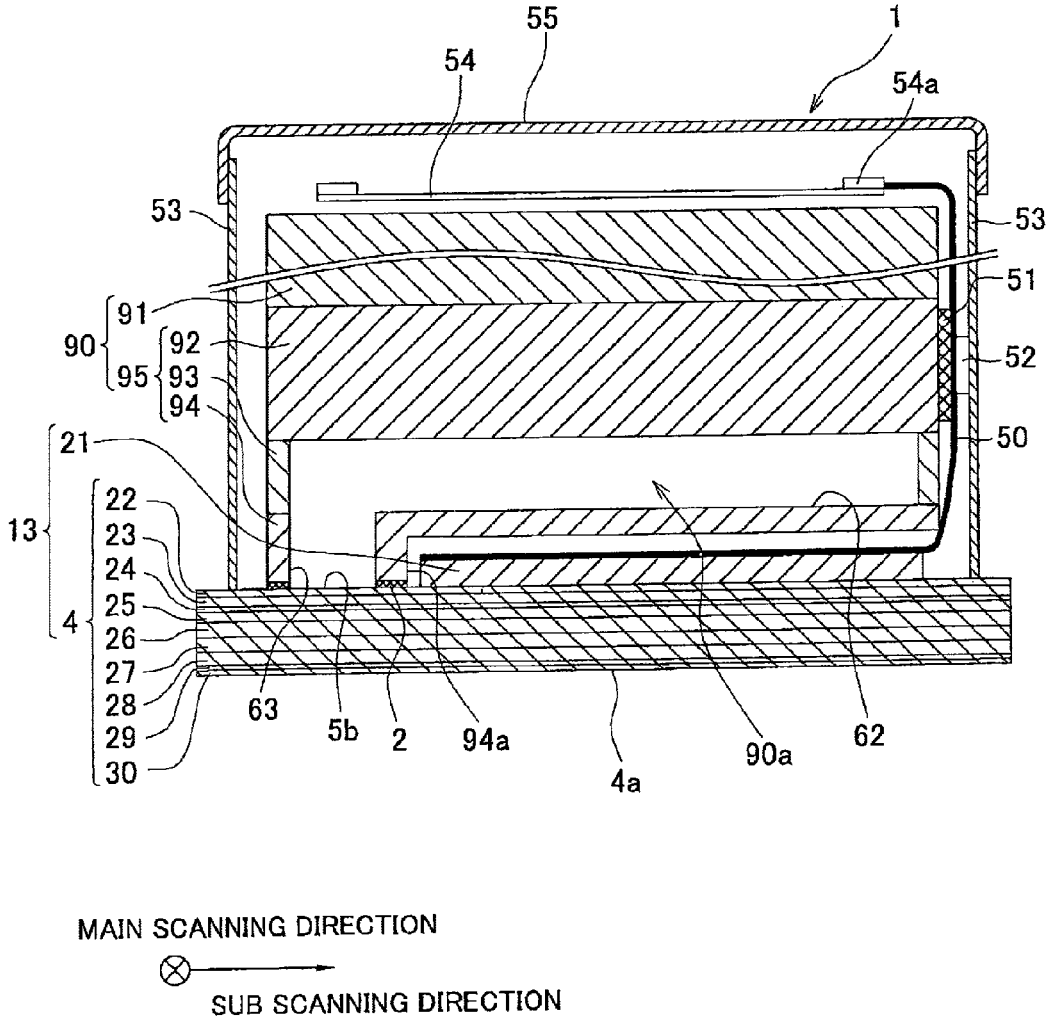
FIG. 2 is a sectional view as taken along line II-II in FIG. 1.

FIG. 2 is a sectional view as taken along line II-II in FIG. 1. As shown in FIG. 1, a head unit 70 includes a frame 71, and four ink-jet heads 1 fixed to the frame 71.

The frame 71 is formed by a flat-plate member made of a metal, and has a rectangular shape elongated in a main scanning direction. The frame 71 has a through opening 72 formed at a center thereof. A shape of the through opening 72 is substantially the same as the shape of the frame. The through opening 72 has such a size that passage units 4 of the respective four ink-jet heads 1 are placeable. The frame 71 has, at each of its lengthwise ends, four positioning holes 73 which are arranged at regular intervals along a sub scanning direction. The frame 71 and the four ink-jet heads 1 are bonded to each other with interposition of an adhesive layer 75 (see FIG. 11C), while being positioned relative to each other by means of the positioning holes 73 and positioning holes 92*a* which are formed in a later-described reservoir base plate 92 of each ink-jet head 1. The head unit formed in this manner is mounted to an ink-jet printer (not shown) via the frame 71.

Each of the ink-jet heads 1 has a substantially rectangular parallelepiped shape elongated in a main scanning direction. The four ink-jet heads 1 are arranged side by side in the sub scanning direction and in this state bonded to both lengthwise ends of the frame 71. The ink-jet heads 1 are supplied with ink of different colors, respectively. For example, magenta ink, cyan ink, yellow ink, and black ink are supplied to the ink-jet heads 1 shown at the near side to the far side in FIG. 1, respectively. That is, the head unit 70 is mounted to a color ink-jet printer (not shown). Since all the ink-jet heads 1 have the same construction, a construction of one ink-jet head 1 will be described below.

As shown in FIG. 2, the ink-jet head 1 includes a head main body 13, a reservoir unit 90, a flexible printed circuit board (FPC) 50, and a control board 54. The head main body 13 has a passage unit 4 and an actuator unit 21. The reservoir unit 90 is disposed on an upper face of the passage unit 4 and supplies ink into the passage unit 4. The FPC 50 is mounted with a driver IC 52 which supplies a drive signal to the actuator unit 21. The control board 54 is electrically connected to the FPC 50.

As shown in FIG. 2, one end of the FPC 50 is electrically connected to an upper face of the actuator unit 21. The control board 54 is disposed above the reservoir unit 90 in a horizontal manner. The other end of the FPC 50 is connected to a connector 54*a* of the control board 54. Based on a command from the control board 54, the driver IC 52 supplies a drive signal to the actuator unit 21 through a wire provided in the FPC 50.

An ink reservoir 90*a* which stores ink therein is formed inside the reservoir unit 90. The ink reservoir 90*a* communicates with openings 5*b* which are formed in an upper face of the passage unit 4. Ink contained in the ink reservoir 90*a* is accordingly supplied through the openings 5*a* to the passage unit 4.

The actuator unit 21, the reservoir unit 90, the control board 54, and the FPC 50 are covered by side covers 53 and a head cover 55 which are made of a metal material, so that intrusion of ink or ink mist scattering outside is prevented. An elastic sponge 51 is interposed between a side face of the reservoir unit 90 and the FPC 50. The sponge 51 presses the driver IC 52 to an inner face of the side cover 53 so that heat generated in the driver IC 52 is quickly dissipated to the outside through the side cover 53 and the head cover 55. Thus, the side covers 53 and the head cover 55 function as a dissipation member, too.

Figure 3:
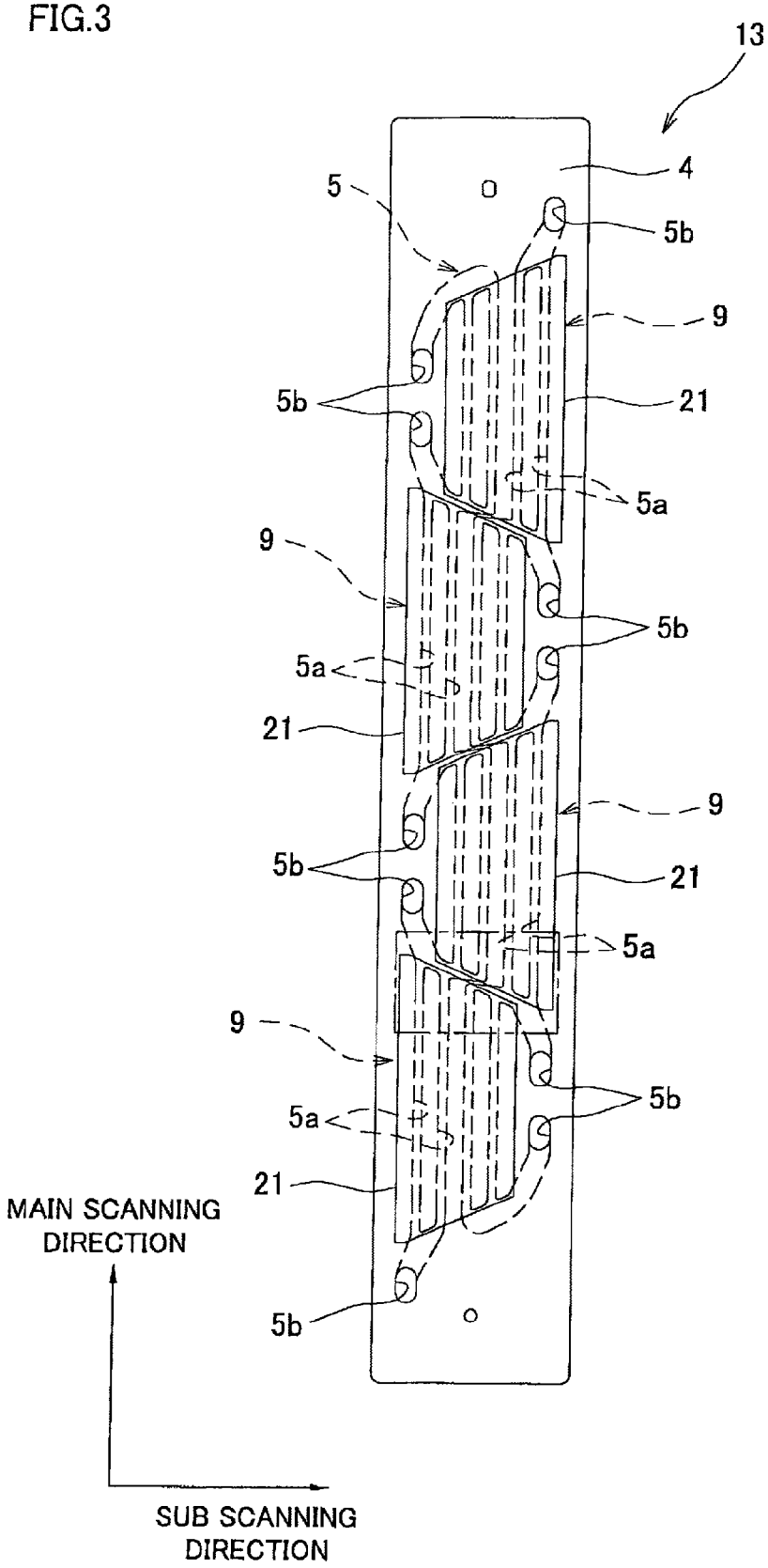
FIG. 3 is a plan view of a head main body.
Figure 4:
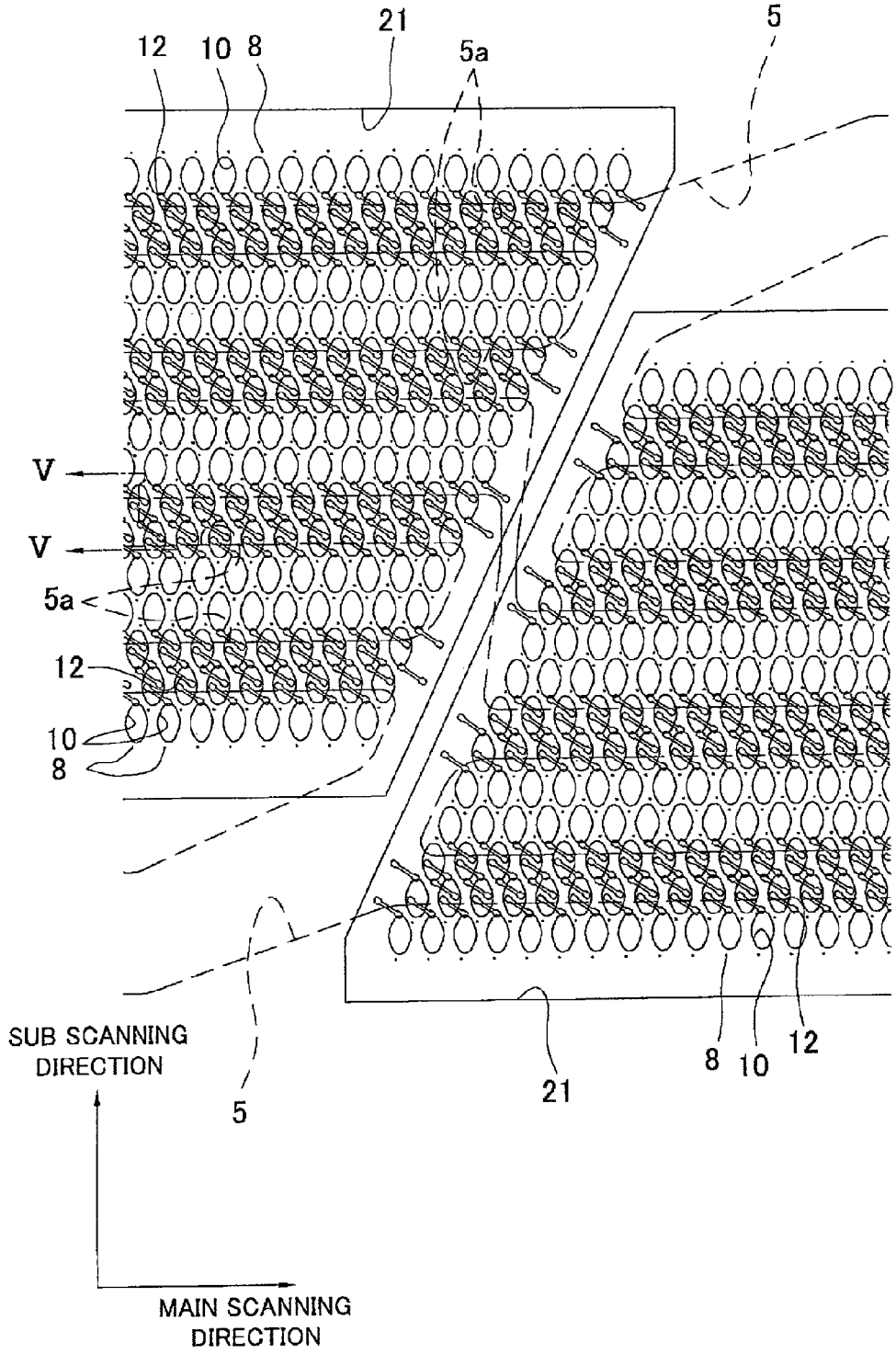
FIG. 4 is an enlarged view of a region enclosed by an alternate long and short dash line in FIG. 3.

Next, the head main body 13 will be described in detail. FIG. 3 is a plan view of the head main body 13. FIG. 4 is an enlarged view of a region enclosed by an alternate long and short dash line in FIG. 3. In FIG. 4, for the purpose of easy understanding, pressure chambers 10, apertures 12, and nozzles 8 are illustrated with solid lines through they locate under the actuator units 21 and therefore actually should be illustrated with broken lines. As shown in FIG. 3, in a plan view, the passage unit 4 has a rectangular shape elongated in the main scanning direction. Four actuator units 21 each having a trapezoidal shape are bonded to the upper face of the passage unit 4 while being arranged in two rows in a zigzag pattern.

In a lower face of the passage unit 4, that is, in an ink-ejection face 4*a*, a plurality of nozzles 8 are opened in regions corresponding to where the respective actuator units 21 are bonded (see FIG. 4). In the upper face of the passage unit 4, a plurality of pressure chambers 10 are opened in regions where the respective actuator units 21 are bonded. The pressure chamber 10 has a substantially rhombic shape with its corners rounded. Both the nozzles 8 and the pressure chambers 10 are arranged in a matrix along two directions. Pressure chambers 10 corresponding to one actuator unit 21 constitute one pressure chamber group 9.

As shown in FIGS. 3 and 4, manifold channels 5 and sub manifold channels 5*a* are formed within the passage unit 4. The manifold channels 5 communicate with the openings 5*b*. The sub manifold channels 5*a* are branched from the manifold channels 5. In regions corresponding to where the actuator units 21 are bonded, the sub manifold channels 5*a* extend along the lengthwise direction of the passage unit 4. On the upper face of the passage unit 4, the pressure chambers 10 are arranged along a direction of extension of the sub manifold channels 5*a*, that is, along the lengthwise direction of the passage unit 4, to form pressure chamber rows. With respect to a widthwise direction of the passage unit 4, there are sixteen parallel pressure chamber rows extending in the lengthwise direction of the passage unit 4. Each pressure chamber row included in one pressure chamber group 9 forms a line with a corresponding pressure chamber row included in a next nearest neighboring pressure chamber group 9. On the ink ejection face, the nozzles 8 are arranged in the same manner as the pressure chambers 10 are.

Figure 5:
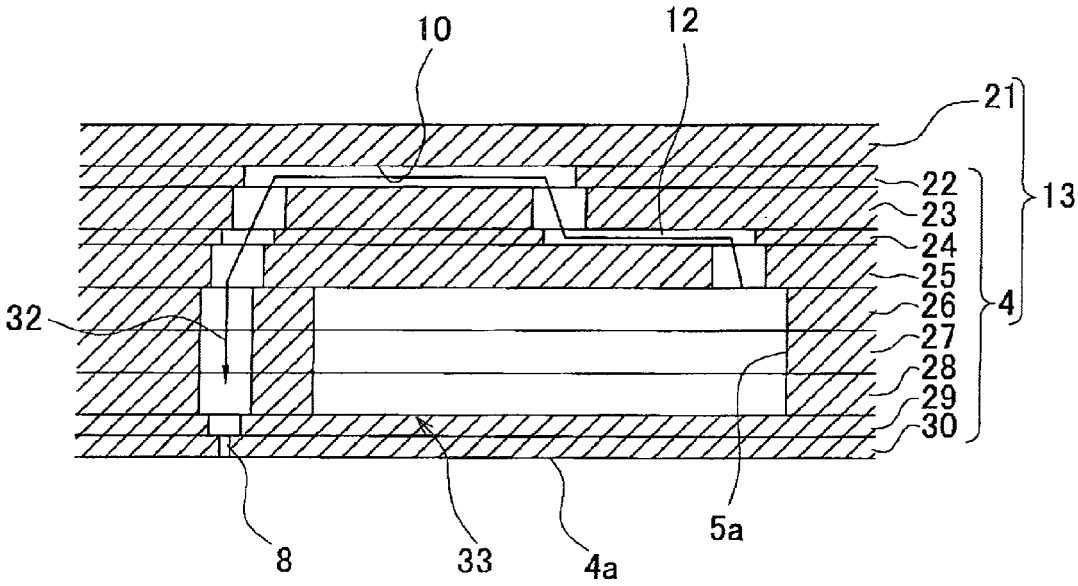
FIG. 5 is a sectional view as taken along line V-V in FIG. 4.

Next, a cross-sectional structure of the head main body 13 will be described. FIG. 5 is a sectional view as taken along line V-V in FIG. 4. As shown in FIG. 5, the head main body 13 is formed by the passage unit 4 and the actuator unit 21 being bonded to each other. The passage unit 4 has a layered structure of nine metal plates, namely, from the top, a cavity plate 22, a base plate 23, an aperture plate 24, a supply plate 25, manifold plates 26, 27, 28, a cover plate 29, and a nozzle plate 30. Holes formed in the respective plates 22 to 30 constitute ink passages 33 within the passage unit 4. The ink passages 33 extend from the openings 5*b* to the respective nozzles 8. The ink passages 33 include the manifold channels 5, the sub manifold channels 5*a*, and individual ink passages 32. The individual ink passages 32 are passages each extending from an exit of a sub manifold channel 5*a* through an aperture and a pressure chamber 10 to a nozzle 8. A plurality of the individual ink passages 32 are formed corresponding to the respective nozzles 8. Each of the actuator units 21 is bonded to the upper face of the passage unit 4 so as to close openings of all the pressure chambers 10 included in a corresponding pressure chamber group 9.

Figure 6A:
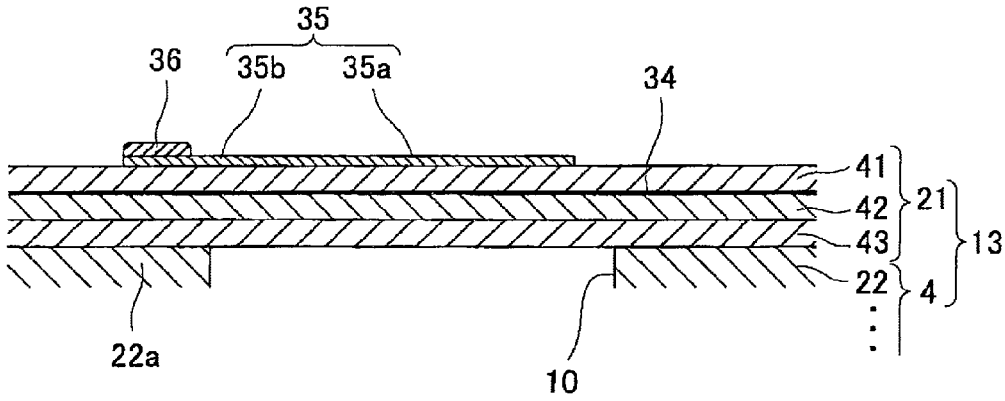
FIG. 6A is a partial sectional view of an actuator unit.
Figure 6B:
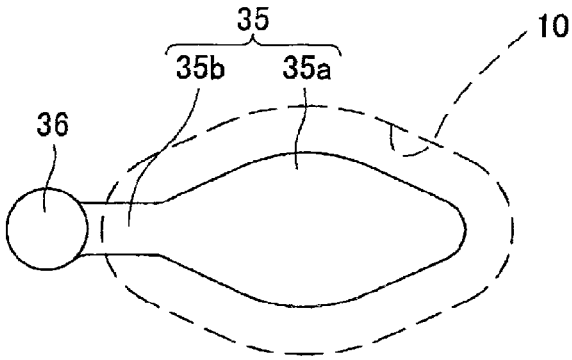
FIG. 6B is a plan view of an individual electrode.

Next, the actuator unit 21 will be described. FIG. 6A is a partial sectional view of the actuator unit 21, and FIG. 6B is a plan view of an individual electrode 35. As shown in FIG. 6A, the actuator unit 21 includes three piezoelectric sheets 41, 42, and 43 each having a thickness of approximately 15 μm. The piezoelectric sheets 41 to 43 are disposed so as to extend over all the pressure chambers 10 included in a corresponding pressure chamber group 9. This makes it possible that individual electrodes 35 corresponding to the respective pressure chambers 10 are arranged on the piezoelectric sheet 41 at a high density by using a screen printing technique for example. The piezoelectric sheets 41 to 43 are made of a lead zirconate titanate (PZT)-base ceramic material having ferroelectricity.

The individual electrode 35 has a thickness of approximately 1 μm, and includes a main electrode portion 35*a* and an extending-out portion 35*b*. As shown in FIG. 6B, the main electrode portion 35*a* has a substantially rhombic shape in a plan view which is substantially the same as but a slightly smaller than the pressure chamber 10. The individual electrode 35 is disposed so as to fall within the pressure chamber 10 in a plan view. The extending-out portion 35*b* extends out from an acute portion of the main electrode portion 35*a* to the outside of the pressure chamber 10, that is, to a position opposed to a wall portion 22*a* of the cavity plate 22 which defines the pressure chambers 10. A circular land 36 having a diameter of approximately 160 μm is provided on a surface of a distal end of the extending-out portion 35*b*.

A common electrode 34 is disposed between the uppermost piezoelectric sheet 41 and the piezoelectric sheet 42 disposed thereunder. The common electrode 34 is formed substantially over an entire upper face of the piezoelectric sheet 42, and grounded in an unillustrated region. As a consequence, a potential can be controlled independently for every individual electrode 35.

The actuator unit 21 is of so-called unimorph type, and includes a plurality of actuators corresponding to the respective individual electrodes 35.

Next, an operation of the actuator unit 21 will be described. When an ejection request is issued from the outside, the driver IC 52 selectively supplies a drive signal to actuators included in the actuator unit 21. A portion of the actuator unit 21 corresponding to the actuator supplied with the drive signal deforms protrudingly toward a pressure chamber 10. This raises pressure of ink contained in the pressure chamber, so that ink is ejected from a corresponding nozzle 8.

Figure 7:
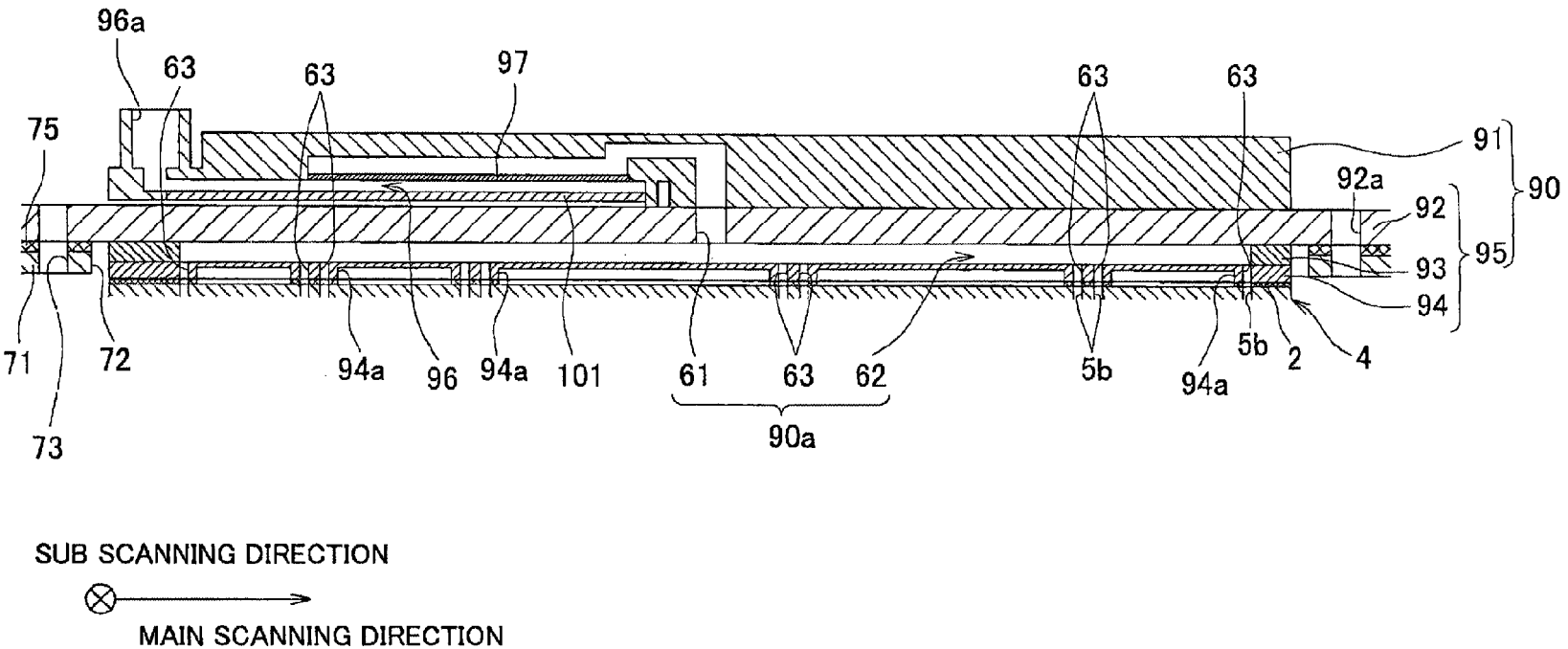
FIG. 7 is a sectional view of a reservoir unit along a longitudinal direction thereof.

Next, the reservoir unit 90 will be described. FIG. 7 is a sectional view of the reservoir unit 90 along a longitudinal direction thereof. As shown in FIGS. 2 and 7, the reservoir unit 90 includes a lower reservoir 95 and an upper reservoir 91. The lower reservoir 95 is bonded to the upper face of the passage unit 4 with a ultraviolet curing resin 2 sandwiched therebetween. The upper reservoir 91 is a made of a resin and disposed on an upper face of the lower reservoir 95. The lower reservoir 95 and the upper reservoir 91 are fixed to each other by screwing.

The lower reservoir 95 is formed by three metal plates, a reservoir base plate 92, a reservoir plate 93, and an under plate 94, being positioned in layers. In a plan view, the plates 92 to 94 have a rectangular shape elongated in the main scanning direction. With respect to the sub scanning direction, the plates 92 to 94 are shorter than a distance between the two side covers 53, as shown in FIG. 2.

As shown in FIGS. 2 and 7, the reservoir base plate 92 is thicker than the plates 93 and 94, and higher in strength and rigidity. With respect to the main scanning direction, the reservoir base plate 92 is longer than the plates 93 and 94 and extends on both sides, as shown in FIGS. 1 and 7. With respect to the main scanning direction, the reservoir plate 93 and the under plate 94 have substantially the same length as that of the nine plates 22 to 30 of the passage unit 4. That is, among the plates 22 to 30 and the plates 92 to 94 which constitute the reservoir unit 90 and the passage unit 4, the reservoir base plate 92 is longest with respect to the main scanning direction. The other plates 22 to 30, 93, and 94 have substantially the same length with respect to the main scanning direction.

Positioning holes 92*a* are formed at both lengthwise ends of the reservoir base plate 92. By positioning the positioning holes 92*a* into an exact overlap with the positioning holes 73 of the frame 71, the respective ink-jet heads 1 are placed in predetermined positions in the frame 71.

As shown in FIG. 7, a through hole 61 is formed in the reservoir base plate 92. The through hole 61 connects an ink passage 96 formed in the upper reservoir 91 to an ink passage 62 formed in the reservoir plate 93. A hole is formed in the reservoir plate 93. The hole serves as the ink passage 62 which connects the through hole 61 to ten through holes 63 formed in the under plate 94. In the under plate 94, through holes 63 are formed at positions opposed to ten openings 5*b* formed on the upper face of the passage unit 4 (see FIG. 3). On a lower face of the under plate 94, a recess 94*a* is formed in a portion where the through holes 63 are not formed. Due to the recess 94*a*, a gap appears between the passage unit 4 and the lower reservoir 95. The actuator unit 21 is disposed in the gap.

The upper reservoir 91 has an ink supplier 96*a* which is shown in an upper-left portion of FIG. 7. An ink supply port is formed on an upper face of the ink supplier 96*a*. Through the ink supply port of the ink supplier 96*a*, ink is supplied to the ink passage 96 within the upper reservoir 91. A damper film 101 is provided at a part of a lower face of the upper reservoir 91. The damper film 101 is spaced from the reservoir base plate 92 by a predetermined distance, and extends in parallel with the reservoir base plate 92. The damper film 101 damps vibration traveling through ink in the ink passage 96. A filter 97 is provided in a middle of the ink passage 96 so as to be opposed to the damper film 101. Ink supplied through the ink supply port of the ink supplier 96*a* has foreign materials removed therefrom by the filter 97, and flows into the lower reservoir 95.

The reservoir unit 90 has the ink passage 96 formed in the upper reservoir 91, and the ink reservoir 90*a* formed in the lower reservoir 95. The ink reservoir 90*a* is made up of the through hole 61, the ink passage 62, and the through holes 63. Ink which has been supplied through the ink supply port of the ink supplier 96*a* into the reservoir unit 90 is supplied through the through holes 63 and the ink supply ports 5*b* into the passage unit 4.

Next, a method of manufacturing the head unit 70 will be described.

Figure 8:
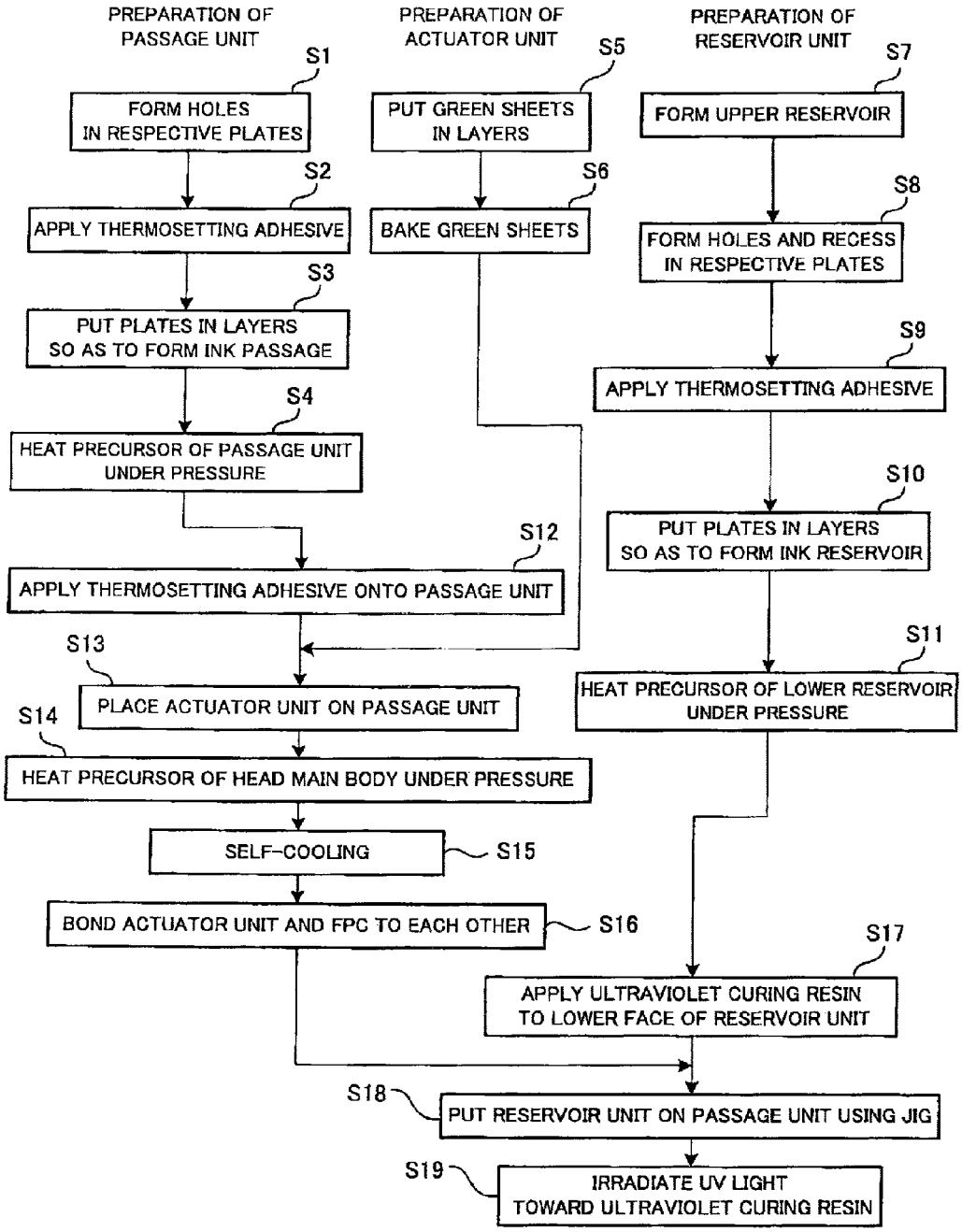
FIG. 8 is a flowchart showing a process of forming an ink-jet head according to the first embodiment of the present invention.
Figure 9A:
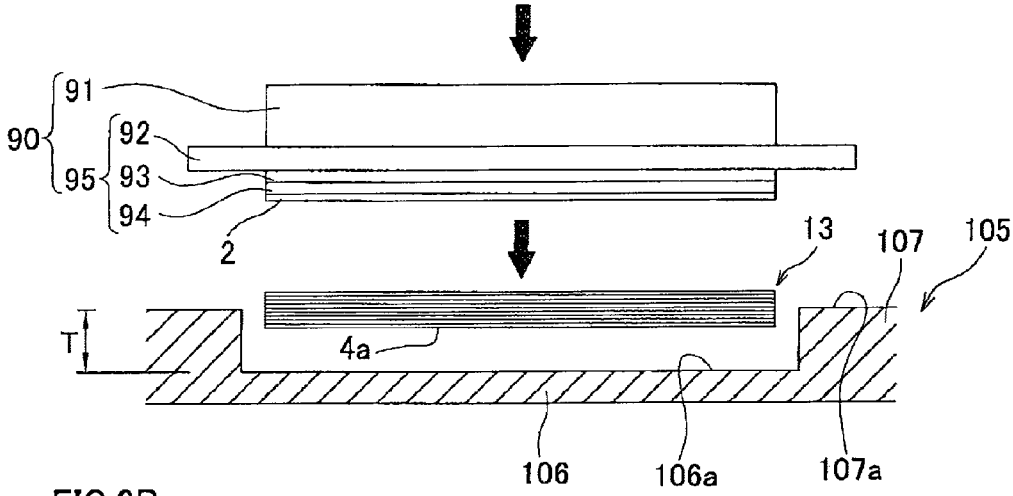
Figure 9B:
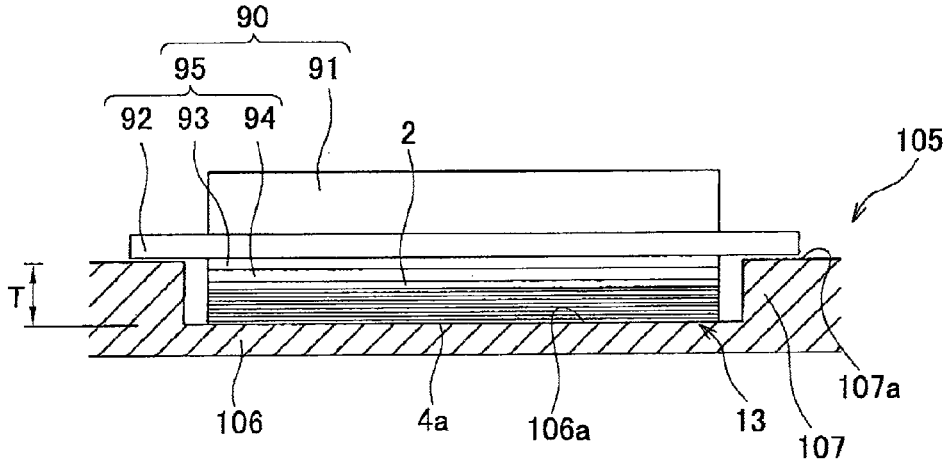
Figure 9C:
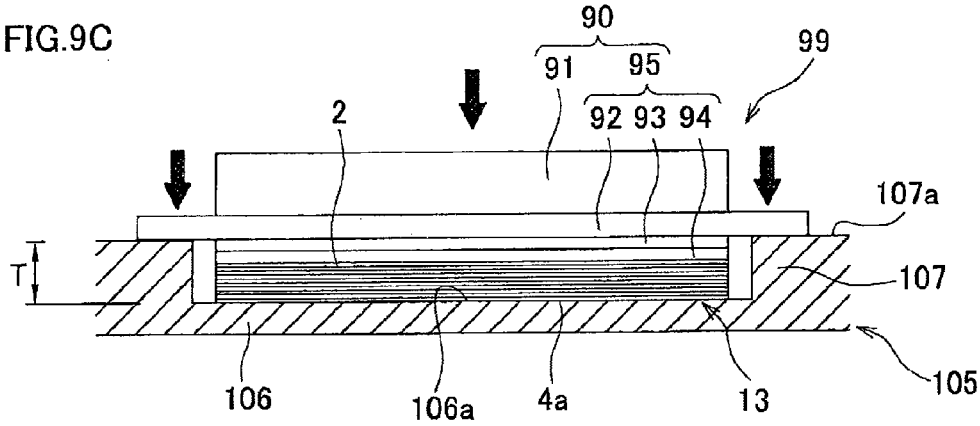

First, a process of forming the ink-jet head 1 will be described. FIG. 8 is a flowchart showing a process of forming the ink-jet head 1 according to the first embodiment of the present invention. FIGS. 9A, 9B, and 9C timewisely show a process of forming the ink-jet head 1 according to the first embodiment of the present invention. To form the ink-jet head 1, parts, namely, the passage unit 4, the actuator unit 21, and the reservoir unit 90, are separately prepared and then the parts are assembled to each other.

A preparation of the passage unit 4 will be described. First, in S1 of FIG. 8, the respective plates 22 to 30 constituting the passage unit 4 are etched using a patterned photoresist as a mask, to thereby form holes which will constitute the ink passage 33 shown in FIG. 5 (hole forming step).

Then, in S2, an epoxy-based thermosetting adhesive is applied to lower faces of the respective plates 22 to 29 other than the nozzle plate 30 (adhesive applying step). Then, in S3, the nine plates 22 to 30 are put in layers with the thermosetting adhesive sandwiched therebetween so as to form the ink passages 33 (passage unit laminating step).

Then, in S4, a layered body obtained in S3, that is, a precursor of the passage unit 4 made up of the nine plates 22 to 30 is heated under pressure up to a temperature equal to or higher than a curing temperature of the thermosetting adhesive. The thermosetting adhesive is thereby cured to bond the nine plates 22 to 30 to one another thereby forming the passage unit 4 (passage unit forming step).

A preparation of the actuator unit 21 will be described. First, three green sheets made of piezoelectric ceramics are prepared. A preparation of the green sheets includes in advance an estimated amount of contraction which will be caused by sintering. On one of the green sheets, a conductive paste is screen-printed in a pattern of the common electrode 34. Then, while the green sheets are positioned to each other by use of a jig, the green sheet printed with the conductive paste in the pattern of the common electrode 34 is put under the green sheet printed with no conductive paste and in addition the other green sheet printed with no conductive paste is put under the green sheet printed with the conductive paste in the pattern of the common electrode 34 (S5).

Then, in S6, a layered body obtained in S5 is degreased in the same manner as for known ceramics, and baked at a predetermined temperature. Thereby, the three green sheets turn into the piezoelectric sheets 41 to 43, and the conductive paste turns into the common electrode 34. Subsequently, a conductive paste is screen-printed in a pattern of the individual electrodes 35, on the uppermost piezoelectric sheet 41. Further, the conductive paste is baked, to form the individual electrodes 35 on the piezoelectric sheet 41. Thereafter, gold including a glass frit is printed on a surface of a distal end of an extending-out portion 35*b* of each individual electrode 35, to form the land 36. In this way, the actuator unit 21 shown in FIGS. 6A and 6B is completed.

A preparation of the reservoir unit 90 will be described. First, a resin member for the upper reservoir 91 is formed by means of a known injection molding method, and then the filter 97 and the damper film 101 are attached to predetermined positions, so that the upper reservoir 91 is prepared (S7).

Then, in S8, the respective plates 92 to 94 constituting the lower reservoir 95 are etched using a patterned photoresist as a mask, to thereby form the recess 94*a* and holes which will constitute the ink reservoir 90*a* shown in FIG. 7 (hole forming step). Here, to form the holes in the respective plates 92 to 94, a pressing process may be adopted instead of an etching process.

Then, in S9, an epoxy-based thermosetting adhesive is applied to lower faces of the two plates 92 and 93 other than the under plate 94 (adhesive applying step). Here, on the lower face of the reservoir base plate 92, the thermosetting adhesive is not applied to both lengthwise ends of the reservoir base plate 92, that is, to portions not opposed to the reservoir plate 93. Then, in S10, the plates 92 to 94 are put in layers with the thermosetting adhesive sandwiched therebetween so as to form the ink reservoir 90*a* (reservoir unit laminating step).

Then, in S11, a layered body obtained in S10, that is, a precursor of the lower reservoir 95 made up of the three plates 92 to 94 is heated under pressure up to a temperature equal to or higher than a curing temperature of the thermosetting adhesive. The thermosetting adhesive is thereby cured to bond the three plates 92 to 94 to one another thereby forming the lower reservoir 95 (reservoir unit forming step). Then, the upper reservoir 91 is placed on the lower reservoir 95 so as to make communication between the ink reservoir 90*a* and the ink passage 96, and the upper reservoir 91 and the lower reservoir 95 are fixed to each other with a screw. In this way, the reservoir unit 90 is completed.

In a case where a heat-resistance temperature of the resin member and the damper film 101 of the upper reservoir 91 is higher than the curing temperature of the thermosetting adhesive, it may be possible to fix the upper reservoir 91 to the precursor of the lower reservoir 95 obtained in S10 with a screw and then heating the precursor of the lower reservoir 95 under pressure to cure the thermosetting adhesive.

The passage unit preparation process S1 to S4, the actuator unit preparation process S5 and S6, and the reservoir unit preparation process S7 to S11 are performed independently of one another, and any one of them may precede another, or alternatively they may be performed concurrently.

Subsequently, in S12, an epoxy-based thermosetting adhesive is applied, using a bar coater, to regions of an upper face of the passage unit 4 obtained in S4 where actuator units 21 will be bonded. Here, application of the adhesive may be done through a transfer method, not limited to using a bar coater.

Then, in S13, four actuator units 21 are placed on the upper face of the passage unit 4 with the thermosetting adhesive applied in S12 sandwiched therebetween. The respective actuator units 21 are positioned relative to the passage unit 4 in such a manner that the individual electrodes 35 and the pressure chambers 10 are opposed to each other. This positioning is based on positioning marks (not shown) which have been formed in the passage unit 4 and the actuator unit 21 beforehand during the steps S1 to S6.

Then, in S14, a layered body made up of the passage unit 4 and the actuator units 21 obtained in S13, that is, a precursor of the head main body 13, is heated under pressure up to a temperature equal to or higher than a curing temperature of the thermosetting adhesive. The thermosetting adhesive is thereby cured, to bond the passage unit 4 and the actuator units 21 to each other. Then, in S15, the precursor of the head main body 13 is self-cooled. Then, in S16, wires of the FPC 50 are bonded to the lands 36 of the actuator units 21. In this way, the head main body 13 is completed.

Then, in S17, a ultraviolet curing resin 2 is applied, in a predetermined thickness, to a portion of a lower face of the reservoir unit 90 where the recess 94*a* is not formed (resin applying step). The ultraviolet curing resin 2 is crosslink-cured by UV light energy. The ultraviolet curing resin 2 is higher in viscosity than the thermosetting adhesives applied in S2, S9, and S12, and can be applied in a predetermined thickness.

Here, a jig 105 which is used in S18 will be described. As shown in FIG. 9A, the jig 105 includes a supporter 106 which supports the ink ejection face 4*a*, and a pair of walls 107 which protrude upward from both sides of the supporter 106. Thus, the jig 105 has a recessed shape in a cross-sectional view. The supporter 106 has a bottom face 106*a* which is in parallel with the ink ejection face 4*a* and slightly larger than one ink ejection face 4*a*. An upper face 107*a* of the wall 107 is in parallel with the bottom face 106*a*. In a plan view, that is, when seen in a direction perpendicular to the bottom face 106*a*, the upper face 107*a* of the wall 107 is located outside the bottom face 106*a*. In addition, with respect to a vertical direction, that is, a direction perpendicular to the bottom face 106*a*, the upper face 107*a* of the wall 107 is at a predetermined distance T from the bottom face 106*a*. The distance T is substantially equal to a total thickness of the nine plates 22 to 30 constituting the passage unit 4, the two plates 93 and 94 other than the reservoir base plate 92 constituting the lower reservoir 95, the thermosetting adhesives existing between the respective plates, and the resin 2 after cured.

In S18, the head main body 13 is placed on the jig 105 in such a manner that the ink ejection face 4*a* of the passage unit 4 is in contact with the bottom face 106*a* of the supporter 106, as shown in FIGS. 9A and 9B. Then, the reservoir unit 90 is put on the passage unit 4 while being positioned relative to the head main body 13 and the jig 105 so as to make communication between the through holes 63 formed in the under plate 94 and the ink supply ports 5*b* of the passage unit 4 and also so as to make opposition between the upper faces 107*a* of the walls 107 and the lower faces of both lengthwise ends of the reservoir base plate 92 (laminating step). At this time, there is a narrow clearance between the upper face 107*a* of the jig 105 and the lower faces of the both lengthwise ends of the reservoir base plate 92, as shown in FIG. 9B. In this step, depending on a viscosity of the ultraviolet curing resin 2, a thickness of the ultraviolet curing resin 2 may decrease due to weight of the reservoir unit 90 to bring the lower faces of the both lengthwise ends of the reservoir base plate 92 into contact with the upper faces 107.

Then, as shown in FIG. 9C, while the ink ejection face 4*a* is kept in contact with the bottom face 106*a*, a layered body 99 made up of the head main body 13 and the reservoir unit 90 is pressed toward the jig 105, that is, pressed downward so as to bring the lower faces of the both lengthwise ends of the reservoir base plate 92 into contact with the upper faces 107*a* of the walls 107. As a result of this pressing, the thickness of the ultraviolet curing resin 2 decreases and the lower faces of the both lengthwise ends of the reservoir base plate 92 comes into contact with the upper faces 107*a*, even though in S18 there has been a clearance between the upper faces 107*a* of the jig 105 and the lower faces of the both lengthwise ends of the reservoir base plate 92 as shown in FIG. 9B. Then, in S19, under this state where the ink ejection face 4*a* is in contact with the bottom face 106*a* while the lower faces of the both lengthwise ends of the reservoir base plate 92 are in contact with the upper faces 107*a*, a UV light irradiator (not shown) irradiates UV light toward the ultraviolet curing resin 2 to cure the ultraviolet curing resin 2 (resin curing step). As a consequence, a distance between the ink ejection face 4*a* and the lower face of the reservoir base plate 92 becomes substantially equal to the distance T between the bottom face 106*a* and the upper face 107*a* of the jig 105.

Thereafter, the FPC 50 and the control board 54 are electrically connected via the connector 54*a*, and besides the side covers 53 and the head cover 55 are assembled on the passage unit 4 so as to cover the actuator unit 21, the reservoir unit 90, the control board 54, and the FPC 50, as shown in FIG. 2. In this way, the ink-jet head 1 is completed.

Figure 10:
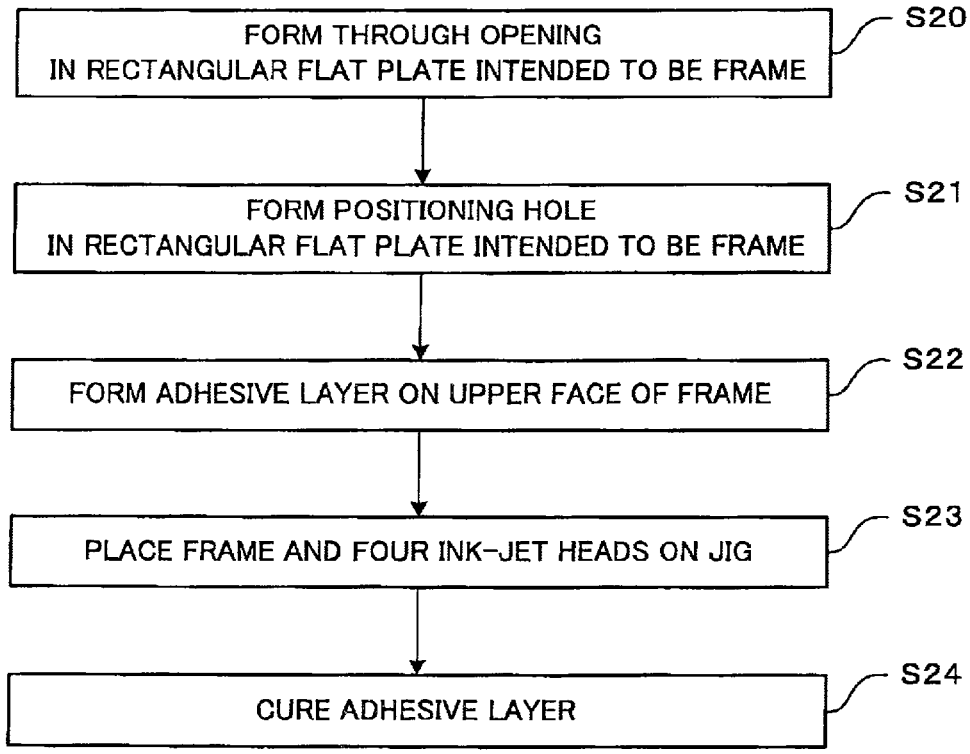
FIG. 10 is a flowchart showing a method of manufacturing a head unit according to the first embodiment of the present invention.
Figure 11A:
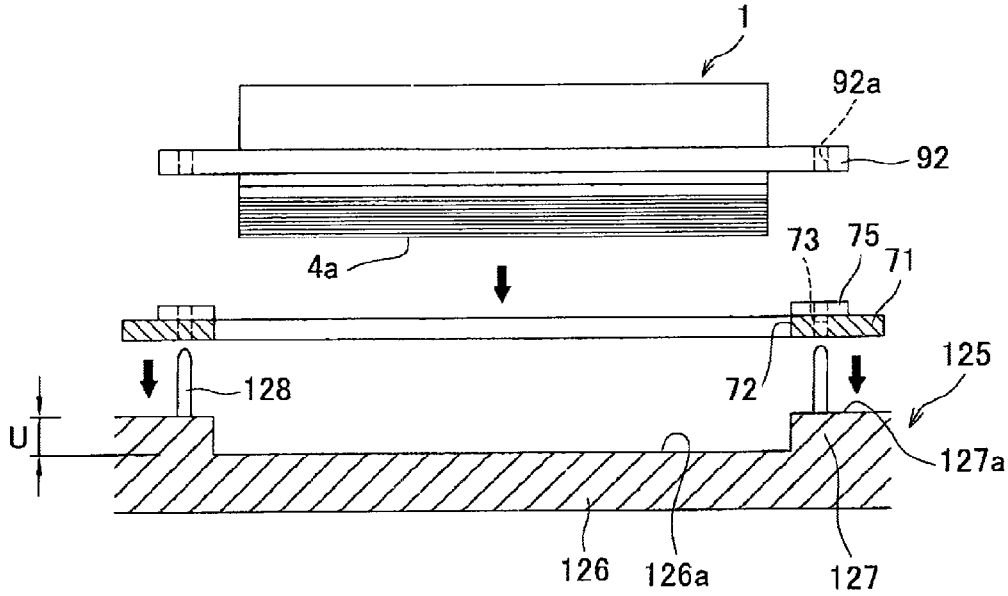
FIGS. 11A, 11B, and 11C timewisely show the method of manufacturing the head unit according to the first embodiment of the present invention.
Figure 11B:
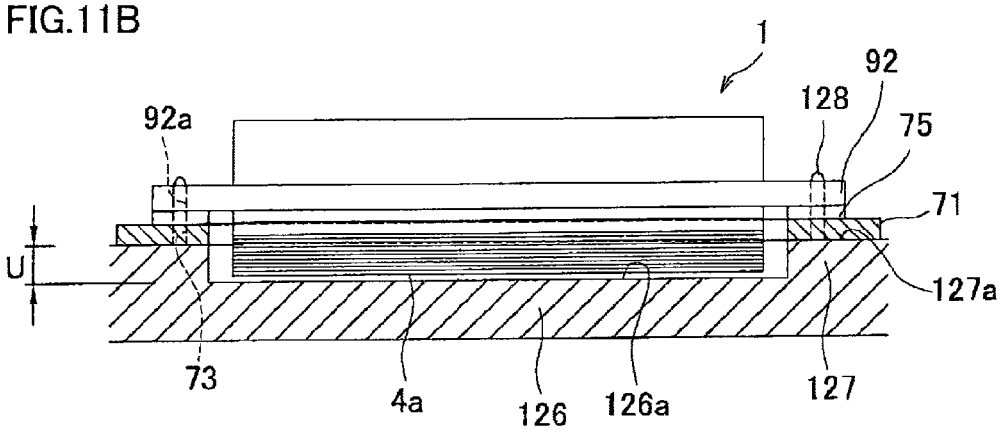
Figure 11C:
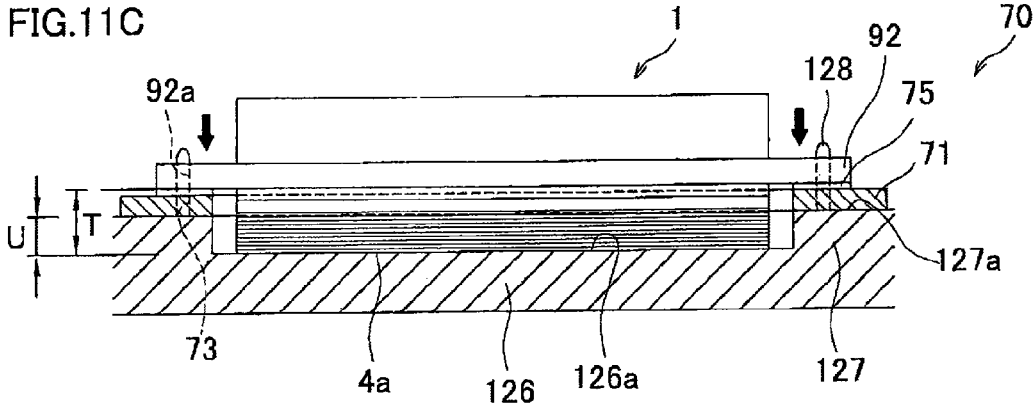

Subsequently, a description will be given to a method of manufacturing a head unit 70 by bonding four ink-jet heads 1 to the frame 71. FIG. 10 is a flowchart showing a method of manufacturing the head unit 70. FIGS. 11A, 11B, and 11C timewisely show a method of manufacturing the head unit 70.

A preparation of the frame 71 will be described. First, in S20, in a rectangular flat plate made of a metal which will be the frame 71, a through hole 72 is formed by a die-stamping process. Then, in S21, at each lengthwise end of the flat plate, four positioning holes 73 are formed at regular intervals along a widthwise direction of the flat plate. The intervals between the positioning holes 73 are set so as to cause no interference among the four ink-jet heads 1 which are positioned with their positioning holes 92*a* overlapping the corresponding positioning holes 73, respectively. In this way, the frame 71 is completed. The frame preparation process S20 and S21 and the ink-jet head forming process S1 to S19 are performed independently of each other, and any one of them may precede the other, or alternatively they may be performed concurrently.

Then, in S22, a thermosetting adhesive is applied to a portion of an upper face of the frame 71 surrounding each positioning hole 73, to thereby form an adhesive layer 75 having a predetermined thickness, as shown in FIG. 11A (adhesive layer forming step) In this embodiment, the thermosetting adhesive used at this time is, like the ultraviolet curing resin 2, higher in viscosity than the thermosetting adhesives applied in S2, S9, and S12, and can be applied in a predetermined thickness.

Here, a jig 125 which is used in S23 will be described. As shown in FIG. 11A, like the jig 105 described above, the jig 125 includes a supporter 126 which supports the ink ejection face 4*a*, and a pair of walls 127 which protrude upward from both sides of the supporter 126. Thus, the jig 125 has a recessed shape in a cross-sectional view. The supporter 126 has a bottom face 126*a* which is in parallel with the ink ejection face 4*a* and slightly larger than the four ink ejection faces 4*a*. An upper face 127*a* of the wall 127 is in parallel with the bottom face 126*a*. In a plan view, that is, when seen in a direction perpendicular to the bottom face 126*a*, the upper face 127*a* of the wall 127 is located outside the bottom face 126*a*. In addition, with respect to the vertical direction, that is, the direction perpendicular to the bottom face 126*a*, the upper face 127*a* of the wall 127 is at a predetermined distance U from the bottom face 126*a*. The distance U is a value obtained by subtracting, from the distance T shown in FIG. 9A, a thickness of the frame 71 and a thickness of the adhesive layer 75 which has become smaller than in S22 due to a later-described pressing process (see FIG. 11C). The jig 125 differs from the jig 105 described above in that it has eight projections 128 which project upward from the bottom face 127*a*.

The projections 128 are provided at regular intervals with respect to a direction perpendicularly crossing the drawing sheet of FIG. 11A. Four projections 128 are provided on each of the pair of walls 127. The projections 128 are formed so as to correspond to the positioning holes 92*a* of the four heads 1 and the positioning holes 73 of the frame 71.

In S23, as shown in FIGS. 11A and 11B, the projections 128 are inserted into the respective positioning holes 73, and the frame 71 is placed on the jig 125 in such a manner that a lower face of the frame 71, that is, a face of the frame 71 opposite to its face formed with the adhesive layer 75 is in contact with the upper face 127*a*. Then, the respective four ink-jet heads 1 are placed on the jig 125 in such a manner that the projections 128 are inserted into the positioning holes 92*a*, the ink ejection faces 4*a* are opposed to the bottom face 126*a*, and the lower faces of the both lengthwise ends of the reservoir base plate 92 are in contact with the adhesive layer 75 (placing step). At this time, the ink ejection faces 4*a* are spaced from the bottom face 126*a*, as shown in FIG. 11B. This is because, as described above, the distance U is a value obtained by subtracting, from the distance T, a total thickness of the frame 71 and the adhesive layer 75 which has become smaller in thickness than in S22 due to a later-described pressing process (see FIG. 11C). In this step, depending on a viscosity of the adhesive layer 75, a thickness of the adhesive layer 75 may decrease due to weight of the reservoir base plate 92 and the upper reservoir 91 to bring the ink ejection face 4*a* into contact with the bottom face 126*a*.

Then, as shown in FIG. 11C, the reservoir base plates 92 of the respective ink-jet heads 1 are pressed toward the jig 125, that is, pressed downward. As a result of this pressing, the thickness of the adhesive layer 75 decreases and the ink ejection face 4*a* comes into contact with the bottom face 126*a*, even though in S23 there has been a clearance between the ink ejection face 4*a* and the bottom face 126*a* as shown in FIG. 11B. Then, in S24, under this state where the ink ejection face 4*a* is in contact with the bottom face 126*a* while the lower faces of the both lengthwise ends of the reservoir base plate 92 are in contact with the adhesive layer 75, the four ink-jet heads 1 and the frame 71 are heated to cure the adhesive layer (adhesive layer curing step). As a consequence, a distance between the lower face of the frame 71 and the ink ejection face 4*a* becomes substantially equal to the distance U between the bottom face 126*a* and the upper face 127*a* of the jig 125. In this way, the head unit 70 is manufactured.

As thus far described above, in the method of manufacturing the head unit 70 according to this embodiment, the adhesive layer 75 is cured in the adhesive layer curing step S24 while the lower faces of the both lengthwise ends of the reservoir base plate 92 are in contact with the adhesive layer 75 and the ink ejection faces 4*a* are in contact with the bottom face 126*a*. Accordingly, a distance between the lower face of the frame 71 and the ink ejection faces 4*a* is constant because it is regulated as the distance U between the bottom face 126*a* and the upper face 127*a* of the jig 125. Therefore, when a plurality of head units 70 are manufactured using the same jig 125, a distance between the lower face of the frame 71 and the ink ejection faces 4*a* is the same in all the head units 70. As a result, in a recording apparatus such as a printer mounted with the respective head units 70 by the frame 71, a level of the ink ejection face 4*a* does not vary among the head units 70 and therefore stable print quality can be obtained.

The head unit 70 includes the four ink-jet heads 1. In the placement step S23, the respective four ink-jet heads 1 are placed on the jig 125 in such a manner that the ink ejection faces 4*a* are opposed to the bottom face 126*a* and the lower faces of the both lengthwise ends of the is reservoir base plate 92 are in contact with the adhesive layer 75. In the adhesive layer curing step S24, under the state where the ink ejection faces 4*a* are in contact with the bottom face 126*a* while the lower faces of the both lengthwise ends of the reservoir base plate 92 are in contact with the adhesive layer 75, the adhesive layer 75 is cured and thus the four ink-jet heads 1 are bonded to the frame 71 through the adhesive layer 75. As a result, the four ink-jet heads 1 included in one head unit 70 have their ink ejection faces 4*a* positioned at the same level.

In the resin application step S17, the ultraviolet curing resin 2 is applied onto the lower face of the reservoir unit 90, that is, onto the plate 94 which is located between the reservoir base plate 92 and the nozzle plate 30. Then, in the lamination step S18, the reservoir unit 90 is put on the passage unit 4 with the ultraviolet curing resin 2 sandwiched therebetween. Then, in the resin curing step S19, the ultraviolet curing resin 2 is cured under the state where the ink ejection faces 4*a* are in contact with the bottom face 106*a* while the lower faces of the both lengthwise ends of the reservoir base plate 92 are in contact with the upper face 107*a*. Accordingly, a distance between the lower face of the reservoir base plate 92 and the ink ejection face 4*a* is constant because it is regulated as the distance T between the bottom face 106*a* and the upper face 107*a* of the jig 105. Therefore, when a plurality of ink-jet heads 1 are formed using the same jig 105, a distance between the lower face of the reservoir base plate 92 and the ink ejection face 4*a* becomes the same in all the ink-jet heads 1. As a result, in a recording apparatus such as a printer mounted with the head unit 70 by the frame 71, the ink ejection faces 4*a* of the four ink-jet heads 1 included in the head unit 70 are at the same level. Therefore, more stable print quality can be obtained.

The reservoir base plate 92 is most rigid among all the plates 92 to 94 which constitute the lower reservoir 95, and not easily deformed by external force. Accordingly, in S10 and S11, the plates 93 and 94 are bonded while following the reservoir base plate 92. Thus, warping of the three plates 92 to 94 constituting the lower reservoir 95 can be suppressed.

All the plates 92 to 94 which constitute the lower reservoir 95 are made of the same material, and the reservoir base plate 92 is thickest among the plates 92 to 94. By using the same material for the plates 92 to 94 and making the reservoir base plate 92 thicker than the other plates like this, the reservoir base plate 92 can easily obtain higher rigidity and therefore the above-described effects can be obtained.

After the reservoir unit 90 and the passage unit 4 are prepared separately, the reservoir unit 90 is put on the passage unit 4 as shown in FIGS. 9A to 9C, to form the layered body 99. In such a case, handling of members is easier than in a case where the plates constituting the reservoir unit 90 and the passage unit 4 are put in layers at one time to form the layered body.

In the resin application step S17, the ultraviolet curing resin 2 is applied to the lower face of the reservoir unit 90. Then, in the lamination step S18, the reservoir unit 90 is put on the passage unit 4 with the ultraviolet curing resin 2 sandwiched therebetween. Accordingly, even though the reservoir unit 90 and the passage unit 4 are prepared separately and then put in layers to form the ink-jet head 1, a distance between the ink ejection face 4*a* and the lower face of the reservoir base plate 92 is constant.

The jig 125 has projections 128 which are inserted into the positioning holes 73 of the frame 71 and the positioning holes 92*a* of the reservoir base plate 92. Therefore, a position of the frame 71 bonded to the reservoir base plate 92 can be stabilized.

Figure 12A:
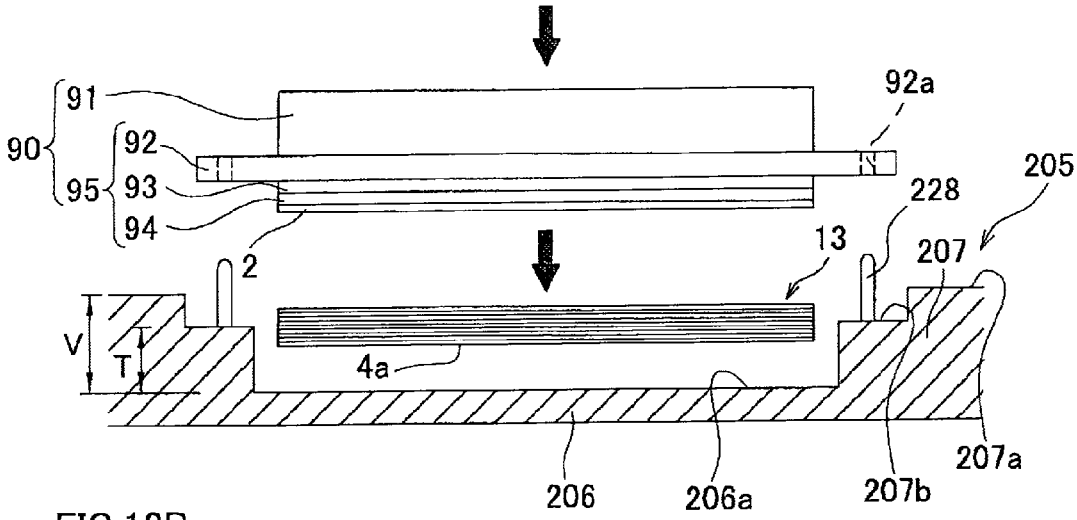
FIGS. 12A, 12B, and 12C timewisely show a process of forming an ink-jet head according to a second embodiment of the present invention.
Figure 12B:
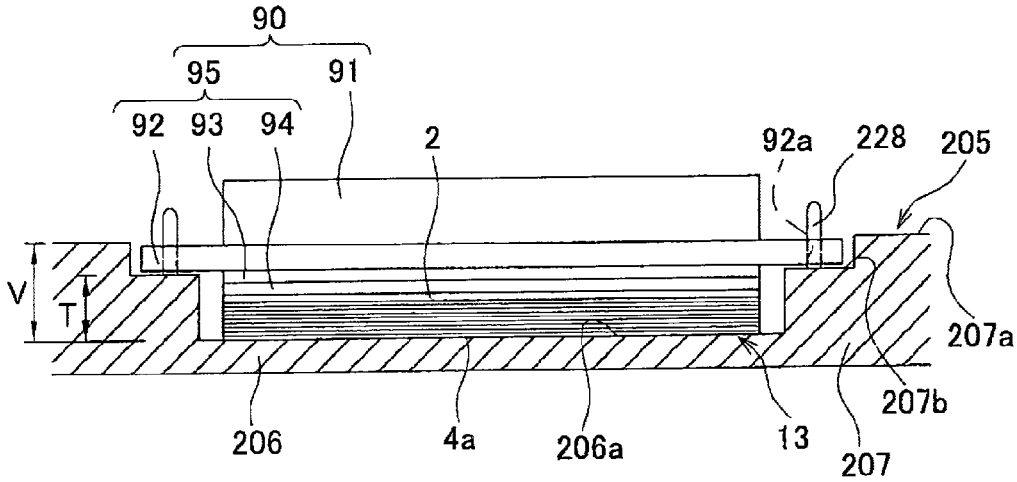
Figure 12C:
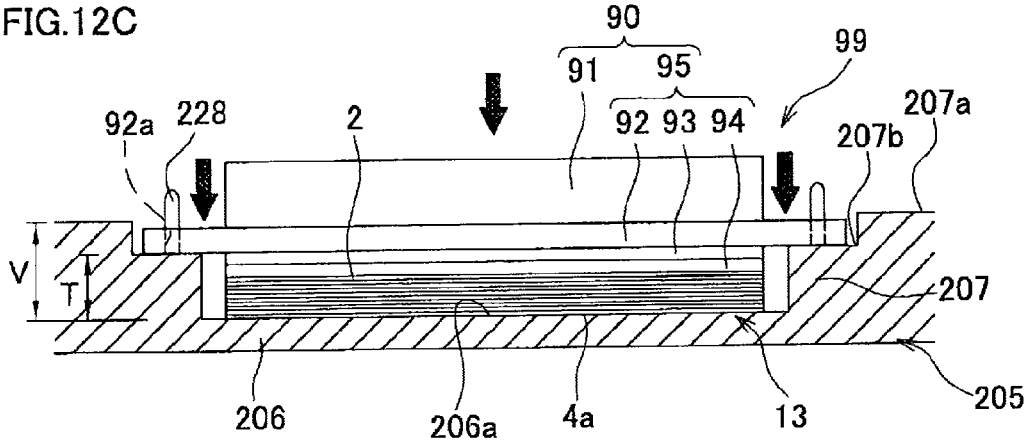
Figure 13:
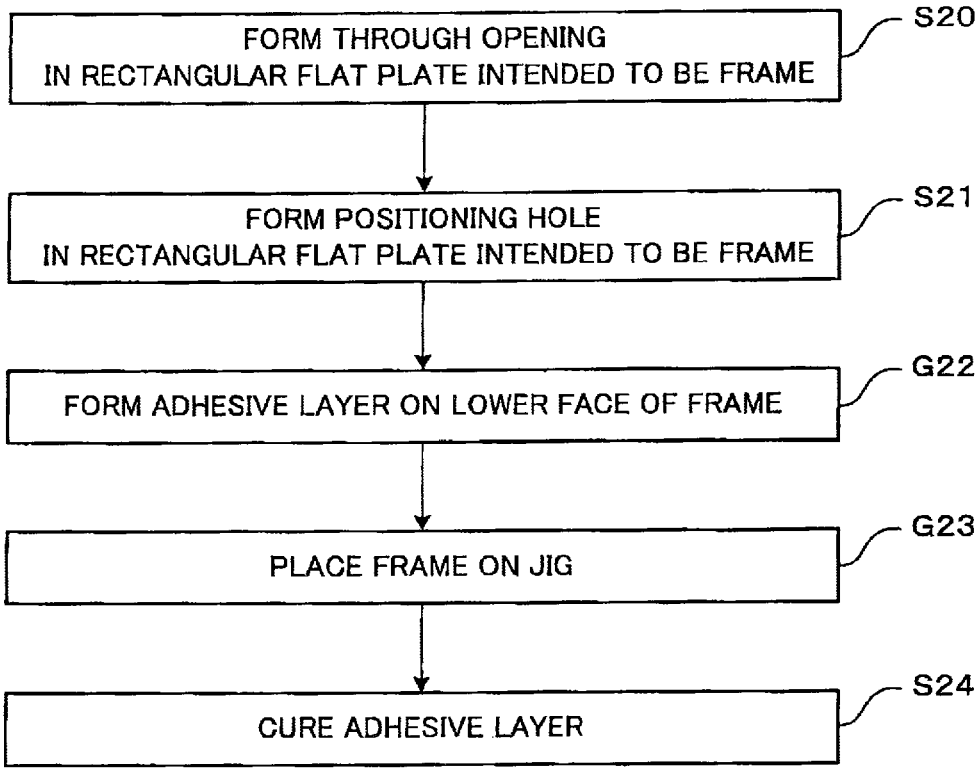
FIG. 13 is a flowchart showing a method of manufacturing a head unit according to the second embodiment of the present invention.
Figure 14A:
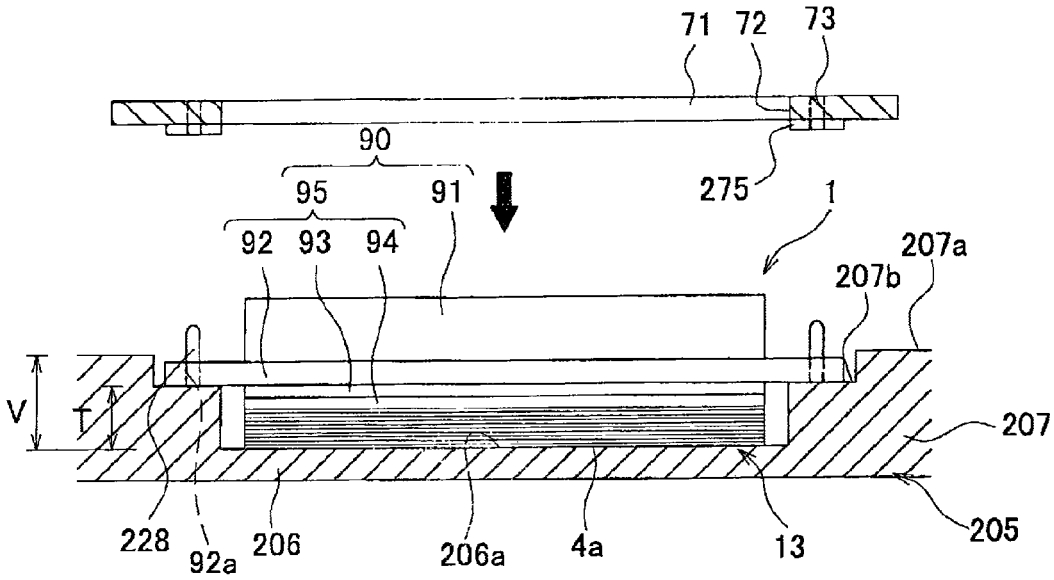
FIGS. 14A and 14B timewisely show the method of manufacturing the head unit according to the second embodiment of the present invention.
Figure 14B:
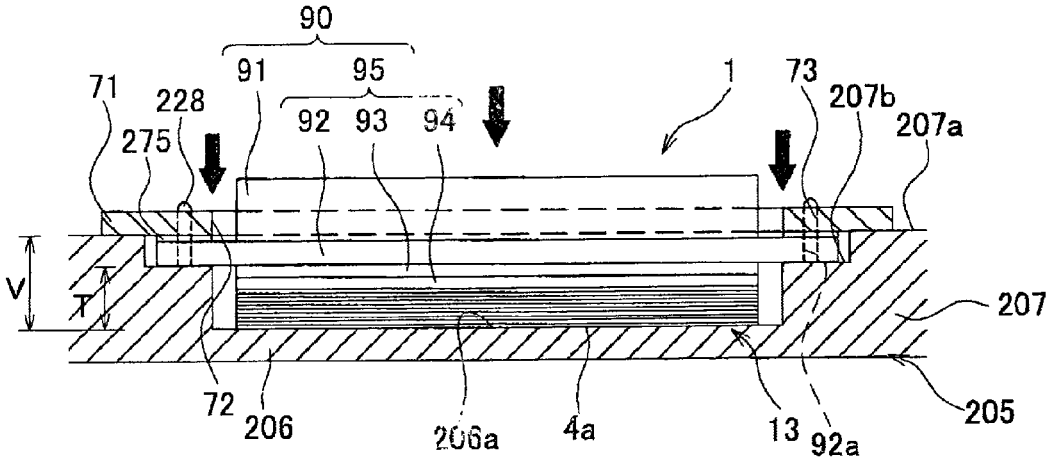

Next, a description will be given to a method of manufacturing a head unit according to a second embodiment of the present invention. FIGS. 12A, 12B, and 12C timewisely show a process of forming an ink-jet head according to the second embodiment of the present invention. FIG. 13 is a flowchart showing a method of manufacturing a head unit according to the second embodiment of the present invention. FIGS. 14A and 14B timewisely show the method of manufacturing the head unit according to the second embodiment of the present invention. This embodiment is substantially the same as the first embodiment except that a positional relationship in the vertical direction between the reservoir base plate 92 and the frame 71 is reverse to in the first embodiment. The same members as in the first embodiment will be denoted by the same reference numerals, and specific descriptions thereof will be omitted.

A process of forming the ink-jet head 1 according to this embodiment will be described. First, the head main body 13 and the reservoir unit 90 are prepared through steps S1 to S17 which are the same as in the first embodiment (see FIG. 8).

Here, a jig 205 which is adopted in this embodiment will be described with reference to FIG. 12A. The jig 205 is used in both a lamination step S18 and a placement step G23.

As shown in FIG. 12A, the jig 205 includes a supporter 206 which supports the ink ejection face 4*a*, and a pair of walls 207 which protrude upward from both sides of the supporter 206. Thus, the jig 205 has a recessed shape in a cross-sectional view. The supporter 206 has a bottom face 206*a* which is in parallel with the ink ejection face 4*a* and slightly larger than the four ink ejection faces 4*a*. An upper face 207*a* of the wall 207 is in parallel with the bottom face 206*a*. In a plan view, that is, when seen in a direction perpendicular to the bottom face 206*a*, the upper face 207*a* of the wall 207 is located outside the bottom face 206*a*. In addition, with respect to the vertical direction, that is, the direction perpendicular to the bottom face 206*a*, the upper face 207*a* of the wall 207 is at a predetermined distance V from the bottom face 206*a*. The distance V is substantially equal to a total thickness of the nine plates 22 to 30 constituting the passage unit 4, the three plates 92 to 94 constituting the lower reservoir 95, the thermosetting adhesives existing between the respective plates, the resin 2 after cured, and an adhesive 275 after cured. The wall 207 has a step surface 207*b* which extends in parallel with the bottom face 206*a*. The step surface 207*b* is located between the bottom face 206*a* and the upper face 207*a* in a plan view, and located between the bottom face 206*a* and the upper face 207*a* with respect to the vertical direction. The step surface 207*b* is at a predetermined distance T from the bottom face 206*a* with respect to the vertical direction. The distance T is the same as the predetermined distance T of the first embodiment, and equal to a value obtained by subtracting, from the distance V, a thickness of the reservoir base plate 92 and a thickness of the resin 275 after cured.

The jig 205 has eight projections 228 which project upward from the step surfaces 207*b*. Like the projections 128 of the first embodiment, the projections 228 are provided at regular intervals with respect to a direction perpendicularly crossing the drawing sheet of FIG. 12A. Four projections 228 are provided on each of the pair of walls 207, so as to correspond to the positioning holes 92*a* of the four heads 1 and the positioning holes 73 of the frame 71.

In this embodiment, in S18, the head main body 13 is placed on the jig 205 in such a manner that the ink ejection face 4*a* of the passage unit 4 is in contact with the bottom face 206*a* of the supporter 206, as shown in FIGS. 12A and 12B. Then, the projections 228 are inserted into the positioning holes 92*a* of the reservoir base plate 92 while lower faces of both lengthwise ends of the reservoir base plate 92 are opposed to the step surfaces 207*b* of the walls 207. Thus, the reservoir unit 90 is put on the passage unit 4 (laminating step). At this time, based on positioning of the reservoir unit 90 made by the projections 228, the head main body 13 is positioned on the bottom face 206*a* so as to make communication between the through holes 63 formed in the under plate 94 and the ink supply ports 5*b* of the passage unit 4. As shown in FIG. 12B, there is a narrow clearance between the step surface 207*b* of the jig 205 and the lower faces of the both lengthwise ends of the reservoir base plate 92. In this step, depending on a viscosity of the ultraviolet curing resin 2, a thickness of the ultraviolet curing resin 2 may decrease due to weight of the reservoir unit 90 to bring the lower faces of the both lengthwise ends of the reservoir base plate 92 into contact with the step surfaces 207*b*.

Then, as shown in FIG. 12C, while the ink ejection face 4*a* is kept in contact with the bottom face 206*a*, a layered body 99 made up of the head main body 13 and the reservoir unit 90 is pressed toward the jig 205, that is, pressed downward so as to bring the lower faces of the both lengthwise ends of the reservoir base plate 92 into contact with the step surfaces 207*b*. As a result of this pressing, the thickness of the ultraviolet curing resin 2 decreases and the lower faces of the both lengthwise ends of the reservoir base plate 92 come into contact with the step surfaces 207*b*, even though in S18 there has been a clearance between the step surfaces 207*b* and the lower faces of the both lengthwise ends of the reservoir base plate 92 as shown in FIG. 12B. Then, in S19, under this state where the ink ejection face 4*a* is in contact with the bottom face 206*a* while the lower faces of the both lengthwise ends of the reservoir base plate 92 are in contact with the step surfaces 207*b*, a UV light irradiator (not shown) irradiates UV light toward the ultraviolet curing resin 2 to cure the ultraviolet curing resin 2 (resin curing step). As a consequence, a distance between the ink ejection face 4*a* and the lower face of the reservoir base plate 92 becomes substantially equal to the distance T between the bottom face 206*a* and the step surface 207*b* of the jig 205.

Thereafter, the FPC 50 and the control board 54 are electrically connected via the connector 54*a*, and besides the side covers 53 and the head cover 55 are assembled on the passage unit 4 so as to cover the actuator unit 21, the reservoir unit 90, the control board 54, and the FPC 50, as shown in FIG. 2. In this way, the ink-jet head 1 is completed.

Subsequently, a description will be given to a method of manufacturing a head unit by bonding four ink-jet heads 1 to the frame 71.

First, as shown in FIG. 13, the frame 71 is prepared through steps S20 and S21 which are the same as in the first embodiment (see FIG. 10).

Then, in G22, a thermosetting adhesive is applied to a portion of a lower face of the frame 71 surrounding each positioning hole 73, to thereby form an adhesive layer 275 having a predetermined thickness, as shown in FIG. 14A (adhesive layer forming step). The thermosetting adhesive used at this time has high viscosity like in the first embodiment.

Then, in G23, the projections 228 are inserted into the positioning holes 73, so that the frame 71 is placed on the jig 205 in such a manner that lower faces of both lengthwise ends of the frame 71 are, in their portions where no adhesive layer 275 is formed, opposed to the upper face 207*a* (placing step). At this time, the adhesive layer 275 comes into contact with upper faces of both lengthwise ends of the reservoir base plate 92. There is a narrow clearance between the upper face 207*a* and the lower faces of the both lengthwise ends of the frame 71. In this step, depending on a viscosity of the adhesive layer 275, a thickness of the adhesive layer 275 may decrease due to weight of the frame 71 to bring the lower faces of the both lengthwise ends of the frame 71 into contact with the upper face 207*a*.

Then, as shown in FIG. 14B, the frame 71 is pressed toward the jig 205, that is, pressed downward. As a result of this pressing, the thickness of the adhesive layer 275 decreases and the lower faces of the both widthwise ends of the frame 71 comes into contact with the upper face 207*a*, even though in G23 there has been a clearance between the upper face 207*a* and the lower faces of the both widthwise ends of the frame 71. Then, a step S24 which is the same as in the first embodiment is performed. In S24, under a state where the ink ejection face 4*a* is in contact with the bottom face 206*a*, the lower faces of the both lengthwise ends of the reservoir base plate 92 are in contact with the step surfaces 207*b*, the upper faces of the both lengthwise ends of the reservoir base plate 92 is in contact with the adhesive layers 275, and the lower face of the both lengthwise ends of the frame 71 are in contact with the upper face 207*a*, the four ink-jet heads 1 and the frame 71 are heated to cure the adhesive layers 275 (adhesive layer curing step). As a consequence, a distance between the ink ejection face 4*a* and the lower face of the frame 71 becomes substantially equal to the distance V between the bottom face 206*a* and the upper face 207*a* of the jig 205. In this way, the head unit is manufactured.

As thus far described above, in the method of manufacturing the head unit according to this embodiment, forming the ink-jet head 1 using the jig 205 is continuously followed by bonding the frame 71 to the ink-jet head 1 using the jig 205, without moving the ink-jet head 1 away from the jig 205. Since the same jig 205 is used for forming the ink-jet head 1 and for bonding the frame 71 to the ink-jet head 1, a total process involved in manufacturing the head unit can be simplified and in addition costs for a jig is reduced to thereby reduce costs for manufacturing a head unit, as compared with when separate jigs are used. Besides, using the single jig 205 serves to relieve a problem of unevenness in size among jigs which may occur when a plurality of jigs are used. This can improve accuracy of a distance between the lower face of the frame 71 and the ink ejection face 4*a*. Thus, a further higher-quality printing can be realized.

Figure 15:
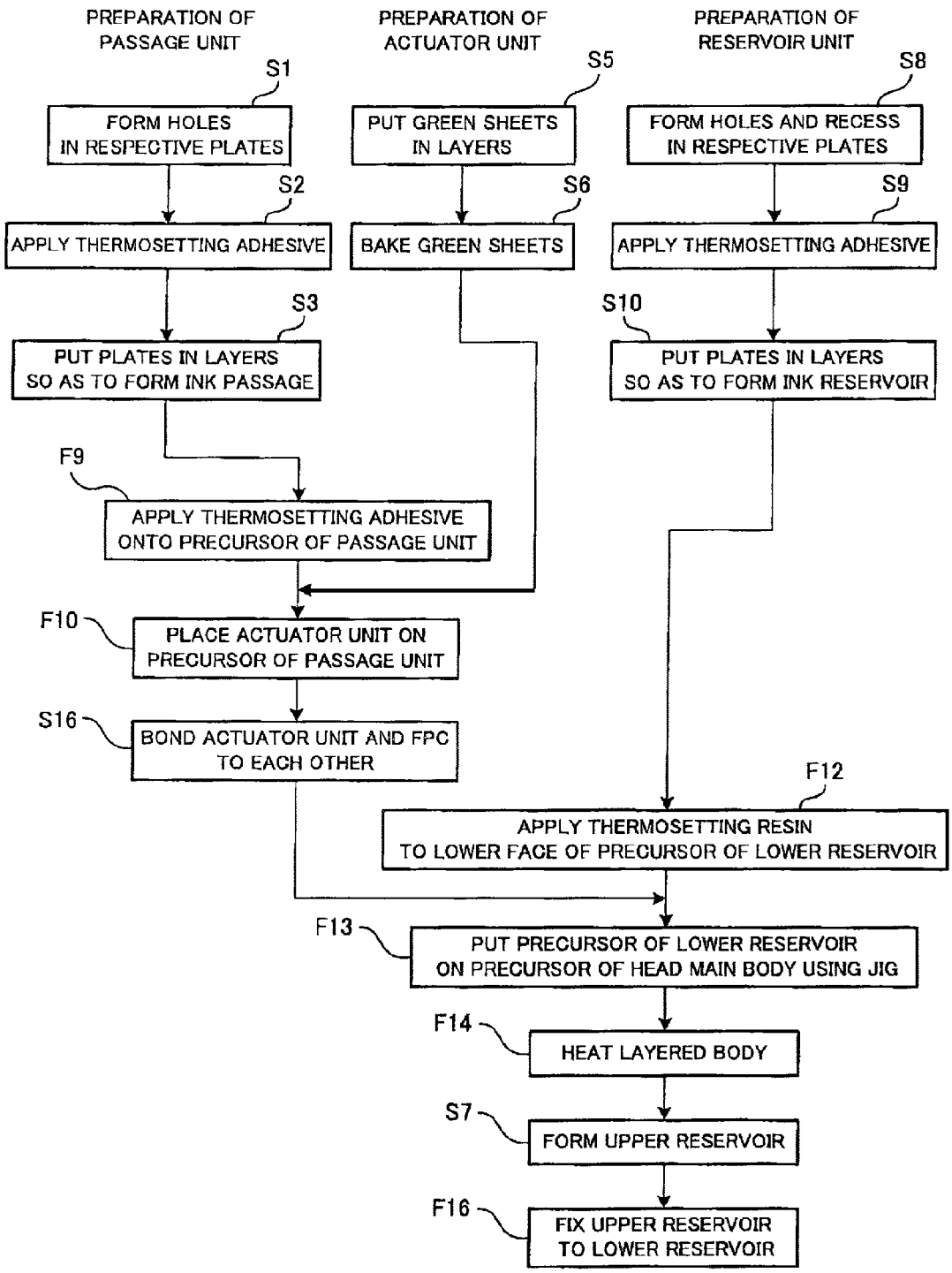
FIG. 15 is a flowchart showing a process of forming an ink-jet head, in a method of manufacturing a head unit according to a third embodiment of the present invention.

Next, a description will be given to a method of manufacturing a head unit according to a third embodiment of the present invention. FIG. 15 is a flowchart showing a process of forming an ink-jet head, in a method of manufacturing a head unit according to a third embodiment of the present invention. A manufacturing method of this embodiment is the same as of the first embodiment except for a process of forming an ink-jet head. The same steps as in the first embodiment shown in FIG. 8 will be denoted by the same reference numerals, and specific descriptions thereof will be omitted.

In this embodiment, a thermosetting resin is used for bonding the reservoir unit 90 and the head main body 13 to each other, although the ultraviolet curing resin 2 is used therefor in the first embodiment. The thermosetting adhesives existing among the respective nine plates 22 to 30 which constitute the passage units 4, among the respective three plates 92 to 94 which constitute the lower reservoir 95, between the passage unit 4 and actuator unit 21, and the thermosetting resin disposed between the reservoir unit 90 and the passage unit 4 are cured simultaneously.

First, as shown in FIG. 15, steps S1 to S3 which are the same as in the first embodiment are performed, to form a precursor of the passage unit 4 made up of the nine plates 22 to 30. Next, steps S5 and S6 which are the same as in the first embodiment are performed, to prepare the actuator unit 21.

Then, through steps S8 to S10 which are the same as in the first embodiment, a precursor of the lower reservoir 95 made up of the three plates 92 to 94 is formed.

Then, steps F9 and F10 which are substantially the same as the steps S12 and S13 of the first embodiment are performed. In F9, an epoxy-based thermosetting adhesive is applied to regions of an upper face of the precursor of the passage unit 4 obtained in S3 where actuator units 21 will be bonded. In F10, four actuator units 21 are placed on the upper face of the precursor of the passage unit 4 with the thermosetting adhesive applied in F9 sandwiched therebetween. At this time, the actuator units 21 are positioned in the same manner as in the first embodiment. Thereby, a precursor of the head main body 13 is formed.

Then, a step S16 which is the same in the first embodiment is performed, to bond wires of the FPC 50 to the lands 36 of the actuator units 21.

Then, in F12, a thermosetting resin 2 is applied, in a predetermined thickness, to a portion of a lower face of the precursor of the lower reservoir 95 where the recess 94*a* is not formed (resin applying step). The thermosetting resin is cured by being heated up to a curing temperature or higher. The thermosetting resin is higher in viscosity than the thermosetting adhesives applied in S2, S9, and F9, and can be applied in a predetermined thickness.

Then, in F13, the precursor of the head main body 13 is placed on the jig 105 in such a manner that a lower face of the precursor of the head main body 13, that is, the ink ejection face 4*a*, is in contact with the bottom face 106*a* of the supporter 106 of the jig 105 which is the same jig 105 as in the first embodiment. Then, the precursor of the lower reservoir 95 is put on the precursor of the head main body 13 with the thermosetting resin interposed therebetween, while being positioned relative to the precursor of the head main body 13 and the jig 105 so as to make communication between the through holes 63 formed in the under plate 94 and the ink supply ports 5*b* of the passage unit 4 and also so as to make opposition between the upper faces 107*a* of the walls 107 and lower faces of both lengthwise ends of the reservoir base plate 92 (laminating step). At this time, like in the first embodiment, there is a narrow clearance between the upper face 107*a* and the lower faces of the both lengthwise ends of the reservoir base plate 92.

Then, while the ink ejection face 4*a* is kept in contact with the bottom face 106*a*, a layered body obtained in F13 made up of the precursor of the head main body 13 and the precursor of the lower reservoir 95 is pressed toward the jig 105, that is pressed downward so as to bring the lower faces of the both lengthwise ends of the reservoir base plate 92 into contact with the upper faces 107*a* of the walls 107. As a result of this pressing, the thickness of the thermosetting resin decreases and the lower faces of the both lengthwise ends of the reservoir base plate 92 come into contact with the upper faces 107*a*, even though in F13 there has been a clearance between the upper faces 107*a* of the jig 105 and the lower faces of the both lengthwise ends of the reservoir base plate 92. Then, in F14, under this state where the ink ejection face 4*a* is in contact with the bottom face 106*a* while the lower faces of the both lengthwise ends of the reservoir base plate 92 are in contact with the upper faces 107*a*, the layered body obtained in F13 is heated, to cure the thermosetting resin (resin curing step). This heating also cures the thermosetting resins existing among the respective nine plates 22 to 30 which constitute the passage units 4, among the respective three plates 92 to 94 which constitute the lower reservoir 95, and between the passage unit 4 and actuator unit 21. Consequently, a layered body made up of the head main body 13 and the lower reservoir 95 is obtained. A distance between the ink ejection face 4*a* and the lower face of the reservoir base plate 92 becomes substantially equal to the predetermined distance T between the bottom face 106*a* and the upper face 107*a* of the jig 105.

Then, through a step S7 which is the same as in the first embodiment, the upper reservoir 91 is formed. Then, in F16, the upper reservoir 91 is placed on the lower reservoir 95 obtained in F14 so as to make communication between the ink reservoir 90*a* and the ink passage 96, and the upper reservoir 91 and the lower reservoir 95 are fixed to each other with a screw. Thereby, a layered body of the head main body 13 and the reservoir unit 90 is formed.

Thereafter, the FPC 50 and the control board 54 are electrically connected via the connector 54*a*, and besides the side covers 53 and the head cover 55 are assembled on the passage unit 4 so as to cover the actuator unit 21 the reservoir unit 90, the control board 54, and the FPC 50, as shown in FIG. 2. In this way, the ink-jet head 1 is completed.

As thus far described above, in the method of manufacturing the head unit according to this embodiment, a plurality of plates included in the ink-jet head 1 are cured and bonded at one time in the resin curing step F14. As a result, as compared with in the first and second embodiments, a process of forming the ink-jet head 1 can be simplified and performed efficiently in a shorter period of time.

It suffices that the head unit 70 includes one or more ink-jet heads 1. The number of ink-jet heads 1 included is not limited to four.

The frame 71 may be a plate member not having the through hole 72. Various constructions are adoptable as long as they can fix the ink-jet head 1.

It may not always necessary that the reservoir base plate 92 is thickest among the plates 92 to 94 constituting the lower reservoir 95. The reservoir base plate 92 may have the same thickness as that of the other plates 93 and 94.

A plate fixed to the frame 71 is not limited to the reservoir base plate 92. The plate may be any of the plates constituting the ink-jet head 1 other than the nozzle plate 30, as long as both ends thereof are not in contact with the other plates.

The projections 128 may not be formed on the upper face 127*a* of the jig 125. In such a case, the positioning holes 73 and 92*a* of the frame 71 and the reservoir base plate 92 may be omitted.

In a case where members included in the ink-jet head 1, such as the upper reservoir 91, the control board 54 and the like, have heat resistance lower than the curing temperature of the thermosetting adhesive which forms the adhesive layer 75, 275, the adhesive layer 75, 275 may be formed by a ultraviolet curing resin. In such a case, in the adhesive layer curing step S24, UV light is irradiated and heating is not performed. Therefore, there is no heat influence on the upper reservoir 91, the control board 54, and the like. Alternatively, it may be possible that the upper reservoir 91, the control board 54, and the like are not mounted in the ink-jet head forming process but they are mounted after the frame 71 is bonded via the adhesive layers 75, 275 to a layered body made up of the passage unit 4, the actuator unit 21, and the lower reservoir 95. This provides a greater degree of freedom in selecting a material for bonding the respective members.

A material for bonding the passage unit 4 and the reservoir unit 90 to each other may not necessarily be higher in viscosity than the thermosetting adhesives disposed among the respective nine plates 22 to 30 which constitute the passage units 4, among the respective three plates 92 to 94 which constitute the lower reservoir 95, and between the passage unit 4 and actuator unit 21. For example, the material may have a viscosity equal to or lower than the viscosity of the above-described thermosetting adhesives. In terms of costs, it is more advantageous that the passage unit 4 and the reservoir unit 90 are bonded to each other using the same adhesive as disposed among the respective plates 22 to 30, among the respective plates 92 to 94, and between the passage unit 4 and actuator unit 21, than using a different material. In a case where the passage unit 4 and the reservoir unit 90 are bonded to each other using a material of lower viscosity, in S18 of the first embodiment, a thickness of the material decreases due to weight of the reservoir unit 90 to bring the lower faces of the both lengthwise ends of the reservoir base plate 92 into contact with the upper faces 107*a* of the walls 107. In a case where the passage unit 4 and the reservoir unit 90 are bonded to each other using a material of lower viscosity, in S18 of the second embodiment, a thickness of the material decreases due to weight of the reservoir unit 90 to bring the lower faces of the both lengthwise ends of the reservoir base plate 92 into contact with the step surfaces 207*b* of the walls 207. In a case where the passage unit 4 and the reservoir unit 90 are bonded to each other using a material of lower viscosity, in F13 of the third embodiment, a thickness of the material decreases due to weight of the precursor of the lower reservoir 95 to bring the lower faces of the both lengthwise ends of the reservoir base plate 92 into contact with the upper faces 107*a* of the walls 107. Therefore, it is not necessary to perform a pressing after S18 and F13.

A material used for bonding the passage unit 4 and the reservoir unit 90 to each other is not limited to a resin, and various materials may be used.

The same applies to a material used for bonding the frame 71 and the reservoir base plate 92 to each other, that is, a material for forming the adhesive layer 75, 275. Thus, in a case where the adhesive layer 75, 275 is formed by a material of lower viscosity, in S23 of the first embodiment, a thickness of the adhesive layer 75 decreases due to weight of the reservoir base plate 92 and the upper reservoir 91 to bring the ink ejection face 4*a* into contact with the bottom face 126*a*. In a case where the adhesive layer 75, 275 is formed by a material of lower viscosity, in G23 of the second embodiment, a thickness of the adhesive layer 275 decreases due to weight of the frame 71 to bring the lower faces of the both lengthwise ends of the frame 71 into contact with the upper face 207*a*. Therefore, it is not necessary to perform a pressing after S23 and G23.

As the material used for bonding the frame 71 and the reservoir base plate 92 to each other, that is, as the material for forming the adhesive layer 75, 275, various materials may be used.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A method of manufacturing a head unit, comprising:

an ink-jet head forming step in which an ink-jet head having an ink passage extending from an ink supply port to a nozzle which ejects ink is formed by putting in layers a plurality of plates which includes a nozzle plate having an ink ejection face on which the nozzle is opened and a fixed base plate to be fixed to a frame, the fixed base plate having both ends not being in contact with other plates of the plurality of plates;

an adhesive layer forming step in which an adhesive layer is formed on the frame;

a placing step in which the frame and the ink-jet head are placed on a first jig having a first face and a second face, the second face is parallel to the first face and located outside the first face when seen in a direction perpendicular to the first face while being at a predetermined distance from the first face with respect to the direction perpendicular to the first face, wherein the frame and the ink-jet head are placed on the first jig in such a manner that a portion of the frame, other than a portion formed with the adhesive layer, is in contact with the second face, the ink ejection face is opposed to the first face, and that the both ends of the fixed base plate are in contact with the adhesive layer; and an adhesive layer curing step in which the adhesive layer is cured after the placing step, under a state where the ink ejection face is in contact with the first face.

2. The method according to claim 1, wherein:

a plurality of the ink-jet heads are formed in the ink-jet head forming step; and in the placing step, each of the ink-jet heads is placed on the jig in such a manner that the ink ejection face is opposed to the first face and the both ends of the fixed base plate are in contact with the adhesive layer.

3. The method according to claim 1, wherein, in the placing step, a face of the frame opposite to a face of the frame formed with the adhesive layer, is brought into contact with the second face.

4. The method according to claim 3, wherein the ink-jet head forming step comprises:

a hole forming step in which one or more holes which constitute the ink passage are formed in each of the plates;

a resin applying step in which either one of a ultraviolet curing resin and a thermosetting resin is applied onto at least one of the plates which is positioned between the fixed base plate and the nozzle plate and in which the holes have been formed in the hole forming step;

a laminating step in which, after the resin applying step, the plates are put in layers in such a manner that the ink ejection face is in contact with a third face of a second jig and the both ends of the fixed base plate are in contact with a fourth face of the second jig, the second jig having the third face and the fourth face which is parallel to the third face and located outside the third face when seen in a direction perpendicular to the third face while being at a distance longer than the predetermined distance from the third face with respect to the direction perpendicular to the third face; and a resin curing step in which, after the laminating step, the resin is cured under a state where the ink ejection face is in contact with the third face and the both ends of the fixed base plate are in contact with the fourth face.

5. The method according to claim 4, wherein the ink-jet head includes:

a passage unit having the nozzle plate and formed with a first ink passage which includes a common ink chamber and an individual ink passage extending from an exit of the common ink chamber to the nozzle through a pressure chamber which is opened on one surface of the passage unit opposite to the ink ejection face; and a reservoir unit having the fixed base plate and fixed to the one surface of the passage unit, the reservoir unit being formed with a second ink passage which connects the ink supply port to the first ink passage, wherein the fixed base plate is most rigid among a plurality of plates which constitute the reservoir unit, and wherein, after the hole forming step and before the laminating step, the method further comprises:

a reservoir unit laminating step in which the plates constituting the reservoir unit are put in layers with a thermosetting adhesive sandwiched therebetween, so as to form the second ink passage;

a reservoir unit forming step in which the reservoir unit is formed by heating under pressure a layered body formed in the reservoir unit laminating step to thereby cure the thermosetting adhesive;

a passage unit laminating step in which the plates constituting the passage unit are put in layers with a thermosetting adhesive sandwiched therebetween, so as to form the first ink passage; and a passage unit forming step in which the passage unit is formed by heating under pressure a layered body formed in the passage unit laminating step to thereby cure the thermosetting adhesive.

6. The method according to claim 5, wherein:

the plates constituting the reservoir unit are made of the same material; and the fixed base plate is thickest among the plates constituting the reservoir unit.

7. The method according to claim 5, wherein, in the laminating step, the reservoir unit formed in the reservoir unit forming step is put on the one surface of the passage unit formed in the passage unit forming step, in such a manner that the first ink passage and the second ink passage communicate with each other.

8. The method according to claim 7, wherein, in the resin applying step, the resin is applied to a face of, among the plates constituting the reservoir unit, a plate which is put on the one surface of the passage unit, and the face is a face opposed to the one surface.

9. The method according to claim 3, wherein:

the first jig has a projection which projects from the second face;

a positioning hole adapted to have the projection inserted therethrough is formed in each of the both ends of the fixed base plate and the frame; and in the placing step, the projection is inserted through the positioning hole.

10. The method according to claim 4, wherein:

in the resin applying step, a thermosetting resin is applied;

the method further comprises, after the hole forming step and before the laminating step, an adhesive applying step in which a thermosetting adhesive is applied to the plates formed with the holes; and in the resin curing step, the thermosetting adhesive applied in the adhesive applying step is cured together with the thermosetting resin applied in the resin applying step.

11. The method according to claim 1, wherein, in the placing step, a face of the frame formed with the adhesive layer is brought into contact with the second face.

12. The method according to claim 11, wherein the first jig further has a fifth face which is parallel to the first face and located between the first face and the second face when seen in a direction perpendicular to the first face while being located between the first face and the second face with respect to the direction perpendicular to the first face, and wherein the ink-jet head forming step includes:

a hole forming step in which one or more holes which constitute the ink passage are formed in each of the plates;

a resin applying step in which either one of a ultraviolet curing resin and a thermosetting resin is applied onto at least one of the plates which is positioned between the fixed base plate and the nozzle plate and in which the holes have been formed in the hole forming step;

a laminating step in which, after the resin applying step, the plates are put in layers in such a manner that the ink ejection face is in contact with the first face and the both ends of the fixed base plate are opposed to the fifth face; and a resin curing step in which, after the laminating step, the resin is cured under a state where the ink ejection face is in contact with the first face and the both ends of the fixed base plate are in contact with the fifth face.

13. The method according to claim 12, wherein the ink-jet head includes:

a passage unit having the nozzle plate and formed with a first ink passage which includes a common ink chamber and an individual ink passage extending from an exit of the common ink chamber to the nozzle through a pressure chamber which is opened on one surface of the passage unit opposite to the ink ejection face; and a reservoir unit having the fixed base plate and fixed to the one surface of the passage unit, the reservoir unit being formed with a second ink passage which connects the ink supply port to the first ink passage, wherein the fixed base plate is most rigid among a plurality of plates which constitute the reservoir unit, and wherein, after the hole forming step and before the laminating step, the method further comprises:

a reservoir unit laminating step in which the plates constituting the reservoir unit are put in layers with a thermosetting adhesive sandwiched therebetween, so as to form the second ink passage;

a reservoir unit forming step in which the reservoir unit is formed by heating under pressure a layered body formed in the reservoir unit laminating step to thereby cure the thermosetting adhesive;

a passage unit laminating step in which the plates constituting the passage unit are put in layers with a thermosetting adhesive sandwiched therebetween, so as to form the first ink passage; and a passage unit forming step in which the passage unit is formed by heating under pressure a layered body formed in the passage unit laminating step to thereby cure the thermosetting adhesive.

14. The method according to claim 12, wherein:

the plates constituting the reservoir unit are made of the same material; and the fixed base plate is thickest among the plates constituting the reservoir unit.

15. The method according to claim 12, wherein, in the laminating step, the reservoir unit formed in the reservoir unit forming step is put on the one surface of the passage unit formed in the passage unit forming step, in such a manner that the first ink passage and the second ink passage communicate with each other.

16. The method according to claim 15, wherein, in the resin applying step, the resin is applied to a face of, among the plates constituting the reservoir unit, a plate which is put on the one surface of the passage unit, and the face is a face opposed to the one surface.

17. The method according to claim 12, wherein:

the first jig has a projection which projects from the fifth face;

a positioning hole adapted to have the projection inserted therethrough is formed in each of the both ends of the fixed base plate and the frame; and in the placing step, the projection is inserted through the positioning hole.

18. The method according to claim 12, wherein:

in the resin applying step, a thermosetting resin is applied;

the method further comprises, after the hole forming step and before the laminating step, an adhesive applying step in which a thermosetting adhesive is applied to the plates formed with the holes; and in the resin curing step, the thermosetting adhesive applied in the adhesive applying step is cured together with the thermosetting resin applied in the resin applying step.

* * * * *